US012648652B2

(12) United States Patent
Wang et al.

(10) Patent No.: US 12,648,652 B2
(45) **Date of Patent: *Jun. 9, 2026**

(54) MULTIFUNCTIONAL BED

(71) Applicant: Nisco Co., Ltd, Rugao (CN)

(72) Inventors: Wei Wang, Rugao (CN); Fahuan Zhang, Rugao (CN); Jian Xie, Rugao (CN)

(73) Assignee: NISCO CO., LTD, Rugao (CN)

( * ) Notice: Subject to any disclaimer, the term of this patent is extended or adjusted under 35 U.S.C. 154(b) by 9 days.

This patent is subject to a terminal disclaimer.

(21) Appl. No.: 18/955,065

(22) Filed: Nov. 21, 2024

(65) Prior Publication Data

US 2025/0204691 A1 Jun. 26, 2025

Related U.S. Application Data

(60) Continuation-in-part of application No. 18/658,040, filed on May 8, 2024, now Pat. No. 12,324,523, which is a continuation of application No. 17/462,191, filed on Aug. 31, 2021, now Pat. No. 11,980,294, which is a continuation-in-part of application No. 17/318,006, filed on May 12, 2021, now Pat. No. 11,839,307, which is a continuation-in-part of application No. 16/729,700, (Continued)

(51) Int. Cl.

| | |
|---|---|
| ***A47C 20/04*** | (2006.01) |
| ***A47C 19/02*** | (2006.01) |
| ***A47C 20/12*** | (2006.01) |

(52) U.S. Cl.
CPC ..... *A47C 20/041* (2013.01); *A47C 19/025* (2013.01); *A47C 20/12* (2013.01)

(58) Field of Classification Search
CPC ... A47C 20/041; A47C 19/025; A47C 21/006; A47C 20/12; A47C 20/027; A47C 7/462; A47C 19/122; A47C 19/126; A61G 7/07; A61G 7/015
See application file for complete search history.

(56) References Cited

U.S. PATENT DOCUMENTS

2007/0219474 A1* 9/2007 Wen ..... A61H 1/005 601/67
2009/0178201 A1* 7/2009 Lujan ..... A61G 7/07 5/630

(Continued)

FOREIGN PATENT DOCUMENTS

WO WO-2016179336 A1 * 11/2016 ..... A61G 7/018

*Primary Examiner* — Matthew Troutman
*Assistant Examiner* — Alison N Labarge
(74) *Attorney, Agent, or Firm* — troutman pepper locke; Tim Tingkang Xia, Esq.

(57) ABSTRACT

This invention relates to a multifunctional bed comprising a support assembly comprising a first support structure and a second support structure foldably connected to the first support structure through a pair of connection mechanisms; a plurality of platforms disposed on the support assembly; a lifting mechanism positioned between the frame structure and the plurality of platforms for operably adjusting positions of at least one of the plurality of platforms so as to adjust the multifunctional bed at a desired position; and a lumbar support mechanism supported by the support assembly for operably providing lumbar support.

19 Claims, 16 Drawing Sheets

Related U.S. Application Data filed on Dec. 30, 2019, now Pat. No. 11,317,729, application No. 18/955,065, filed on Nov. 21, 2024 is a continuation-in-part of application No. 18/372,899, filed on Sep. 26, 2023, now Pat. No. 12,502,003, which is a continuation-in-part of application No. 17/873,286, filed on Jul. 26, 2022, now Pat. No. 12,440,035, which is a continuation-in-part of application No. 17/506,052, filed on Oct. 20, 2021, now Pat. No. 12,089,745, which is a division of application No. 16/747,842, filed on Jan. 21, 2020, now Pat. No. 11,178,974, which is a continuation-in-part of application No. 16/729,700, filed on Dec. 30, 2019, now Pat. No. 11,317,729, application No. 18/955,065, filed on Nov. 21, 2024 is a continuation-in-part of application No. 17/238,371, filed on Apr. 23, 2021, now Pat. No. 12,329,285.

(60) Provisional application No. 63/605,680, filed on Dec. 4, 2023, provisional application No. 63/029,800, filed on May 26, 2020, provisional application No. 62/796,172, filed on Jan. 24, 2019, provisional application No. 62/796,154, filed on Jan. 24, 2019, provisional application No. 62/790,583, filed on Jan. 10, 2019, provisional application No. 62/789,047, filed on Jan. 7, 2019, provisional application No. 62/789,062, filed on Jan. 7, 2019.

(56) References Cited

U.S. PATENT DOCUMENTS

| | | | | |
|---|---|---|---|---|
| 2011/0101749 | A1* | 5/2011 | Shih | A47C 7/425 297/284.7 |
| 2012/0246826 | A1* | 10/2012 | Jin | A47C 19/124 5/400 |
| 2014/0000033 | A1* | 1/2014 | Clenet | A61G 7/072 5/613 |
| 2019/0239653 | A1* | 8/2019 | Shan | A47C 20/041 |
| 2019/0328593 | A1* | 10/2019 | Choi | A61G 7/018 |
| 2020/0107646 | A1* | 4/2020 | Sherman | A47C 21/006 |
| 2020/0154899 | A1* | 5/2020 | Brown | A47C 20/12 |
| 2022/0000269 | A1* | 1/2022 | Shan | A47C 20/12 |

* cited by examiner

MULTIFUNCTIONAL BED

CROSS-REFERENCE TO RELATED PATENT APPLICATIONS

This application claims priority to and benefit of U.S. Provisional Patent Application Ser. Nos. 63/605,680 filed Dec. 4, 2023, and Chinese Patent Application Serial No. 202323163544.3, filed Nov. 23, 2023.

This application is also a continuation-in-part application of U.S. patent application Ser. No. 18/658,040, filed May 8, 2024, which itself is a continuation application of U.S. patent application Ser. No. 17/462,191, filed Aug. 31, 2021, now U.S. Pat. No. 11,980,294, which claims priority to and benefit of Chinese Patent Application Serial No. 202121521952.X, filed Jul. 5, 2021, and is a continuation-in-part application of U.S. patent application Ser. No. 17/318,006, filed May 12, 2021, now U.S. Pat. No. 11,839,307, which claims priority to and the benefit of U.S. Provisional Patent Application Ser. No. 63/029,800, filed May 26, 2020, and is a continuation-in-part application of U.S. patent application Ser. No. 16/729,700, filed Dec. 30, 2019, now U.S. Pat. No. 11,317,729, which itself claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019.

This application is also a continuation-in-part application of U.S. patent application Ser. No. 18/372,899, filed Sep. 26, 2023, which itself claims priority to and benefit of Chinese Patent Application Serial No. 202222570883.2, filed Sep. 28, 2022, and is a continuation-in-part application of U.S. patent application Ser. No. 17/873,286, filed Jul. 26, 2022, which is a continuation-in-part application of U.S. patent application Ser. No. 17/506,052, filed Oct. 20, 2021, now U.S. Pat. No. 12,089,745, which is a divisional application of U.S. patent application Ser. No. 16/747,842 filed Jan. 21, 2020, now U.S. Pat. No. 11,178,974, which itself claims priority to and the benefit of U.S. Provisional Patent Application Ser. Nos. 62/796,154 filed Jan. 24, 2019 and 62/796,172 filed Jan. 24, 2019, and is a continuation-in-part of U.S. patent application Ser. No. 16/729,700 filed Dec. 30, 2019, now U.S. Pat. No. 11,317,729, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019.

This application is also a continuation-in-part application of U.S. patent application Ser. No. 17/238,371, filed Apr. 23, 2021, which itself claims priority to and the benefit of Chinese Patent Application Nos. 202022289556.0 filed Oct. 15, 2020.

Each of the above identified applications is incorporated herein in their entireties by reference.

FIELD OF THE INVENTION

The invention generally relates to a bed, and more particular to a multifunctional bed.

BACKGROUND OF THE INVENTION

Sleep is critical for people in every aspect of their lives. Beds are necessary furniture for people to sleep on. A conventional bed usually has few functionalities and occupies a relatively large area of the living space for people and is not convenient to carry. Thus, it is beneficial and desirable for people to have a bed system that is foldable to reduce the space for storage and transportation. It is also beneficial and desirable that the bed system can adjust body positions based on user's sleep preference so that the user achieves maximum comfort during sleep. It is further beneficial and desirable that the bed system can provide vibroacoustic therapy and play music.

SUMMARY OF THE INVENTION

In one aspect, the invention relates to a multifunctional bed. The multifunctional bed includes a support assembly comprising a first support structure and a second support structure foldably connected to the first support structure through a pair of connection mechanisms; a plurality of platforms disposed on the support assembly; a lifting mechanism positioned between the frame structure and the plurality of platforms for operably adjusting positions of at least one of the plurality of platforms so as to adjust the multifunctional bed at a desired position; and a lumbar support mechanism supported by the support assembly for operably providing lumbar support.

In one embodiment, the plurality of platforms comprises a back platform, a first seat platform, a second seat platform, a thigh platform and a leg platform, each of which having a lower edge and an upper edge, wherein the first seat platform is fixedly attached to a lower portion of the pair of the first side rails of the first support structure and the second seat platform is fixedly attached to an upper portion of the pair of the second side rails of the second support structure such that the lower edge of the first seat platform is adjacent to the upper edge of the second seat platform, and wherein the lower edge of the back platform is pivotally connected to the upper edge of the first seat platform, the upper edge of the thigh platform is pivotally connected to the lower edge of the second seat platform, and the upper edge of the leg platform is pivotally connected to the lower edge of the thigh platform.

In one embodiment, the plurality of platforms further comprises a head platform pivotally connected to the upper edge of the back platform.

In one embodiment, the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails.

In one embodiment, the first support structure has a length, L1, defined between the upper and lower ends of the pair of first side rails and a width, W1, defined between the two ends of the upper rail, and the second support structure has a length, L2, defined between the upper and lower ends of the pair of second side rails and a width, W2, defined between the two ends of the lower rail, and wherein L2 is less than L1, and W2 is less than W1.

In one embodiment, the mounting support bar has a bottom portion; a first side tab and a second side tab vertically extended from two opposite ends of the bottom portion, respectively; and a first flange and a second flange vertically extended from free ends of the first side tab and the second side tab, respectively, outwardly along with the bottom portion, wherein the first flange and the second flange are respectively connected to the pair of first side rails, such that each of the first side tab and the second side tab and the inner side of the corresponding one of the pair of first side rails define a space therebetween, and when the first support structure and the second support structure are folded, each of the pair of second side rails of the second support structure is received in the corresponding space.

In one embodiment, the second support structure further comprises a pair of leg support bars, each leg support bar having one end pivotally connected to one of the pair of second side rails at its lower portion, and another end pivotally connected to the leg platform.

In one embodiment, each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein, wherein the notched receptacle has a width defined between the first side tab and the second side tab.

In one embodiment, each of the lower ends of the pair of first side rails and the upper ends of the pair of second side rails has a groove formed for accommodating the connection plate of each connection mechanism.

In one embodiment, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket.

In one embodiment, each connection mechanism further comprises first and second support sleeves, wherein the first support sleeve is disposed between the first side tab of the connection bracket and the inner side of the lower end of one of the pair of first side rails of the first support structure, and the second support sleeve is disposed between the second side tab of the connection bracket and the outer side of the upper end of the corresponding one of the pair of second side rails of the second support structure, so that the pair of second side rails of the second support structure is aligned between the pair of first side rails of the first support structure.

In one embodiment, the lumbar support mechanism comprises a lumbar support member; a linkage member; and a first lumbar lifting assembly and a second lumbar lifting assembly, each of the first and second lumbar lifting assemblies comprising a fixing bracket, a long leg, a short leg, wherein the fixing bracket is operably supported by the support assembly; the long leg has an upper end pivotally connected to the lumbar support member, and a lower end operably movable in the fixing bracket and pivotally connected to the linkage member; and the short leg has an upper end pivotally connected to a middle portion of the long leg, and a lower end pivotally connected to the fixing bracket, such that a distance between the lumbar support member and the linkage member is changeable between a minimal distance and a maximal distance when the linkage member moves between a first position and a second position.

In one embodiment, the fixing bracket has a guiding slot having first and second ends, the guiding slot being configured to moveably receive a guiding pin that pivotally connects the lower end of the long leg to the linkage member, such that when the guiding pin moves to the first end of the guiding slot, the linkage member moves to the first position, and when the guiding pin moves to the second end of the guiding slot, the linkage member moves to the second position. In one embodiment, each of the first and second lumbar lifting assemblies further comprises a bearing member accommodated and operably movable in the fixing bracket, the bearing member being pivotally connected to the lower end of the long leg.

In one embodiment, the bearing member comprises at least one sliding block or at least one roller pivotally connected to the lower end of the long leg and the linkage member by the guiding pin or shaft that is movably received in the guiding slot of the fixing bracket, such that when the lower end of the long leg is driven to move in the fixing bracket, the guiding pin or shaft moves along the guiding slot of the fixing bracket and the at least one roller rotates on a bottom wall of the fixing bracket.

In one embodiment, the lumbar support mechanism further comprises a lumbar support actuator operably connected to the lower end of the long leg of one of the first lumbar lifting assembly and the second lumbar lifting assembly for operably moving the linkage member between the first position and the second position.

In one embodiment, the lumbar support actuator comprises a motor member, an outer tube extending from the motor member, and an activation rod received in the outer tube, engaged with the motor member and configured to be telescopically movable relative to the outer tube according to a direction of motor rotation.

In one embodiment, the motor member is operably supported by the support assembly, and a distal end of the activation rod is pivotally connected to the lower end of the long leg of said one of the first lumbar lifting assembly and the second lumbar lifting assembly, or pivotally connected to a guiding pin or shaft that pivotally connects the lower end of the long leg of said one of the first lumbar lifting assembly and the second lumbar lifting assembly to the linkage member.

In one embodiment, the lifting mechanism comprises a back lifting actuator pivotally connected between the mounting support bar of the first support structure and the back platform for operably driving the back platform to pivotally move in an upward rotating direction or a downward rotating direction relative to the first support structure.

In one embodiment, the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the mounting support bar of the first support structure and the second end portion of the activation rod is pivotally connected to the back platform, or wherein the motor member is pivotally connected to the back platform and the second end portion of the activation rod pivotally connected to the mounting support bar of the first support structure.

In one embodiment, the lifting mechanism comprises a leg lifting actuator pivotally connected between the second support structure and the leg platform for operably driving the leg platform to pivotally move in an upward rotating direction or a downward rotating direction relative to the second support structure.

In one embodiment, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the lower rail of the second support structure and the second end portion of the activation rod pivotally connected to the leg platform, or wherein the motor member is pivotally connected to the leg platform and the second end portion of the activation rod pivotally connected to the lower rail of the second support structure.

In one embodiment, the lifting mechanism comprises a head platform tilting actuator pivotally and directly connected to the head platform and the back platform for operably adjusting the head platform in a tilting position or a flat position relative to the back platform, In one embodiment, the head platform tilting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally and directly connected to the back platform by a back platform mounting bracket that is directly mounted on the back platform, and the activation rod has a distal end portion pivotally and directly connected to the head platform by a head platform mounting bracket having a reinforcement angle bracket holding a lower edge portion of the head platform and a head mounting bracket protruded from the reinforcement angle bracket.

In one embodiment, the multifunctional bed further comprises one or more massage devices spatial-separately installed on the plurality of platforms.

In one embodiment, each massage device comprises a casing mounted onto a respective platform; a sonic vibrator; and a vibrator accommodating member received in the casing, comprising an inner plate having an opening defined in the middle for accommodating the sonic vibrator therein and an outer plate spatially surrounding the inner plate and connected to the inner plate by a plurality of clastic connectors.

In one embodiment, each elastic connector is formed in an S shape and has one end connected to the inner plate and the other end connected to the outer plate, such that the inner plate is operably vibrable relative to the outer plate.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
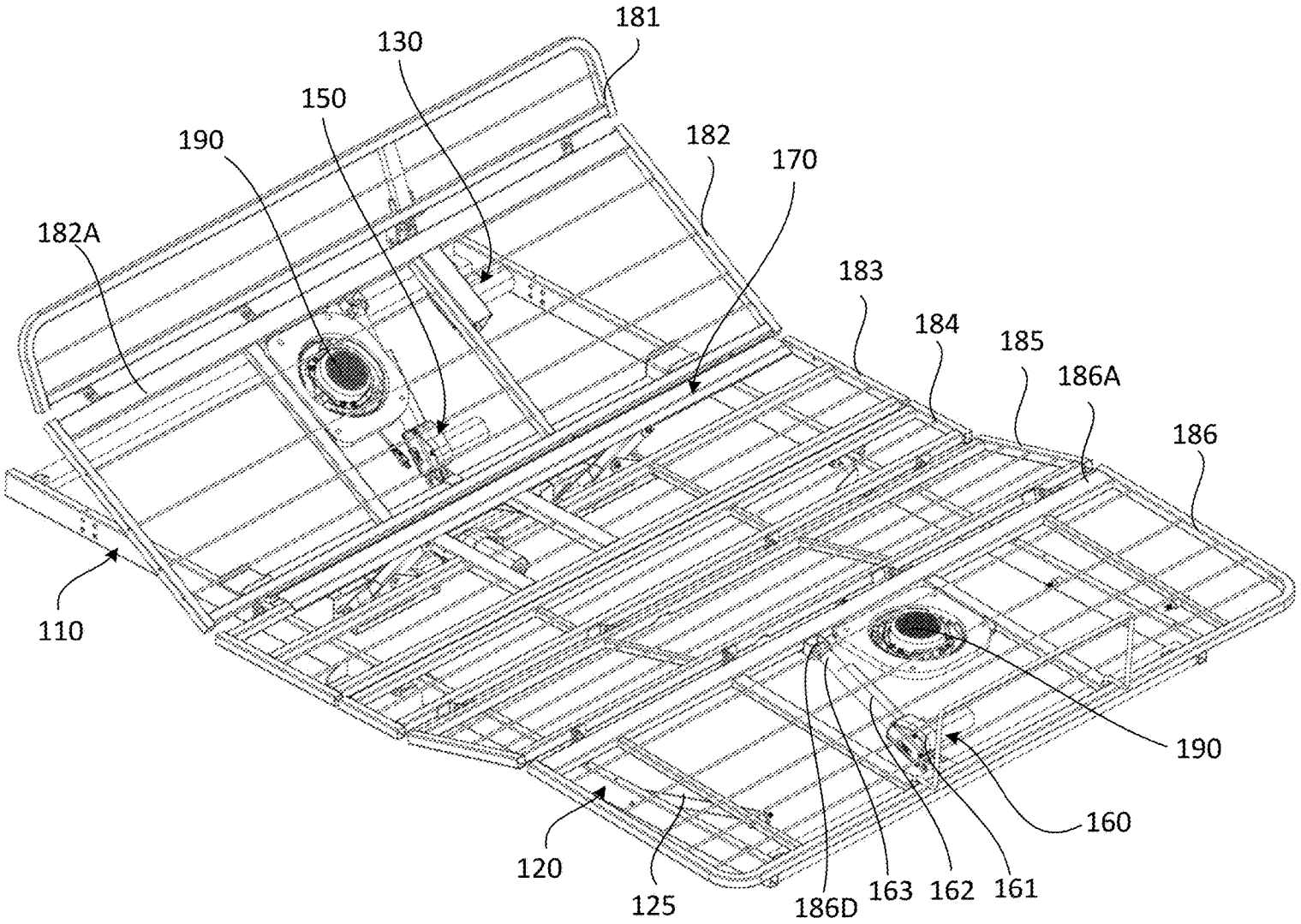
FIG. 1 shows a top perspective view of a multifunctional bed with bed platforms/boards in an adjusted state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated. As used in this specification, the term "board" or "platform" refers to a bed board or a bed panel.

As used in this specification, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-15. In accordance with the purposes of this invention, as embodied and broadly described herein, this invention, in one aspect, relates to a multifunctional beds with foldable connection mechanisms.

Referring to FIGS. 1-15, the multifunctional bed includes a plurality of platforms; a support assembly comprising a first support structure 110 and a second support structure 120 for supporting the plurality of platforms 181-186; and a pair of connection mechanisms 140 for connecting the first support structure 110 to the second support structure 120.

Figure 5A:
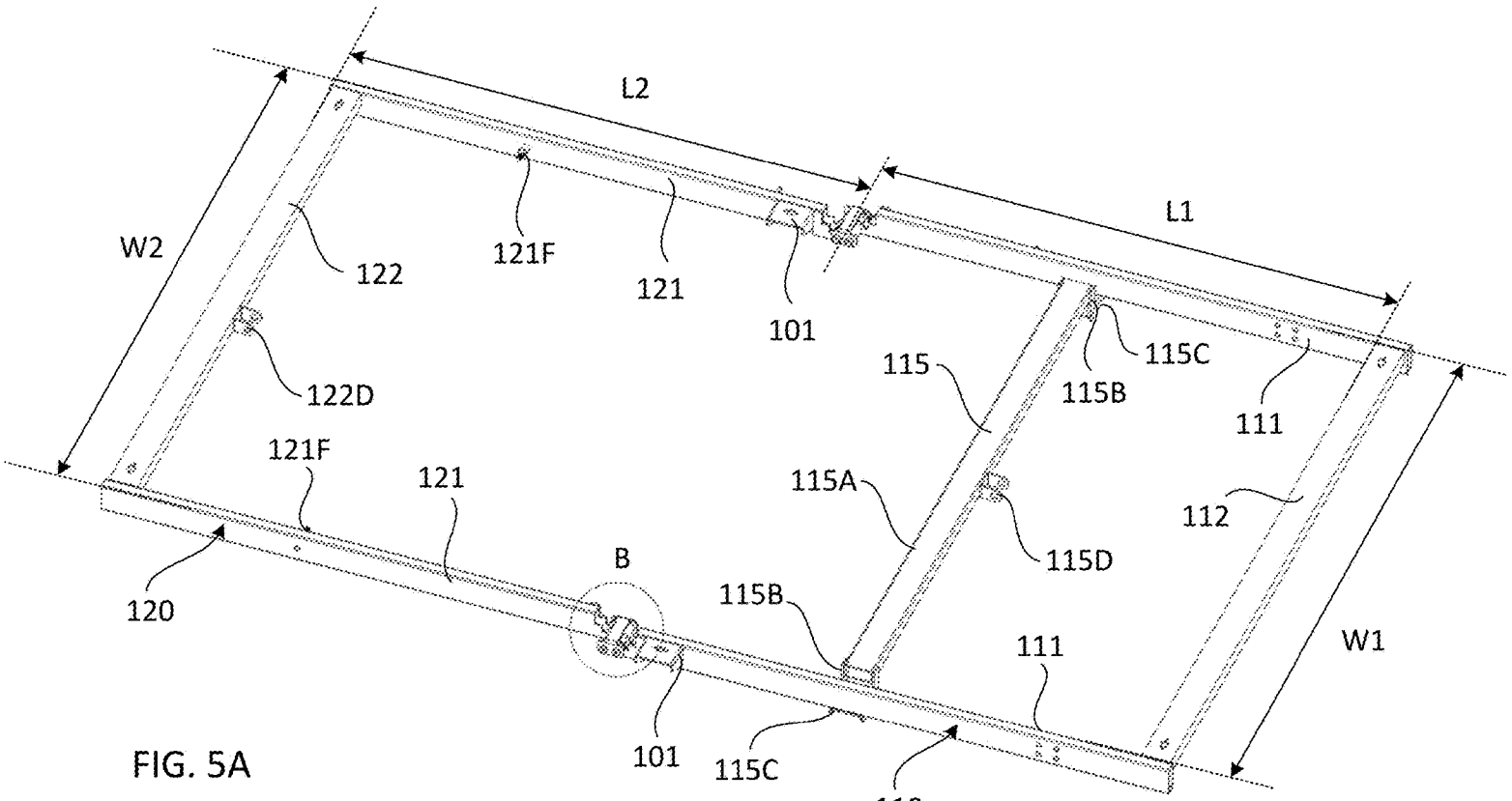
FIG. 5A shows a perspective view of a support assembly of the multifunctional bed shown in FIG. 1.

As shown in FIG. 5A, the first support structure 110 has a pair of first side rails 111 transversely spaced and longitudinally aligned and each first side rail 111 having an upper end and a lower end; an upper rail 112 having two ends respectfully and fixedly connected to the upper ends of the pair of first side rails 111; and a mounting support bar 115 fixedly connected to the pair of first side rails 111 and being parallel to the upper rail 112. The second support structure 120 has a pair of second side rails 121 transversely spaced and longitudinally aligned and each second side rail 121 having an upper end and a lower end; and a lower rail 122 having two ends respectfully and fixedly connected to the lower ends of the pair of second side rails 121. The fixed connections between the first side rails 111 and the upper rail 112 of the first support structure 110 and between the second side rails 121 and the lower rail 122 of the second support structure 120 can be achieved by any fixed connection means such as welding means, molding means, screwing means, mating connections, or the likes.

Figure 2:
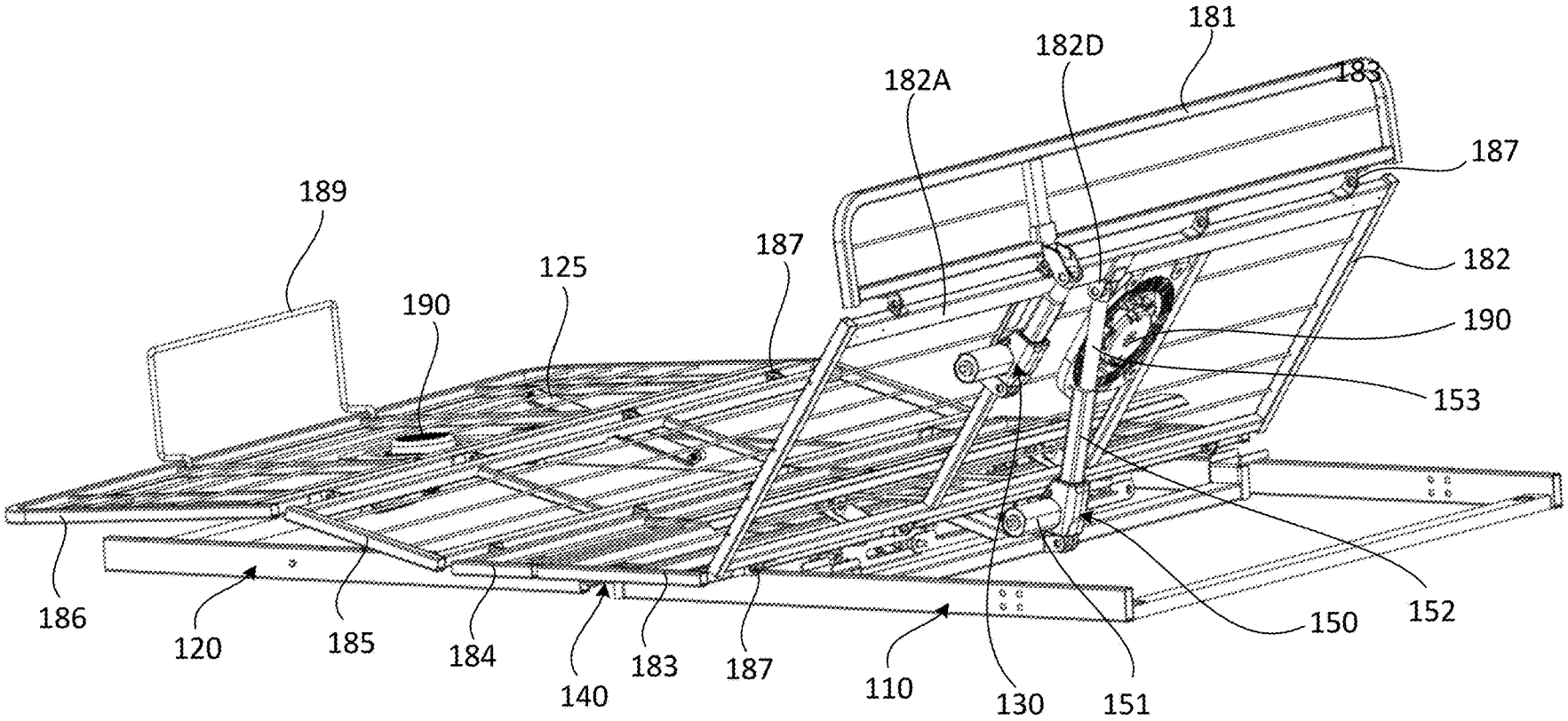
FIG. 2 shows a rear side perspective view of the multifunctional bed shown in FIG. 1.
Figure 3B:
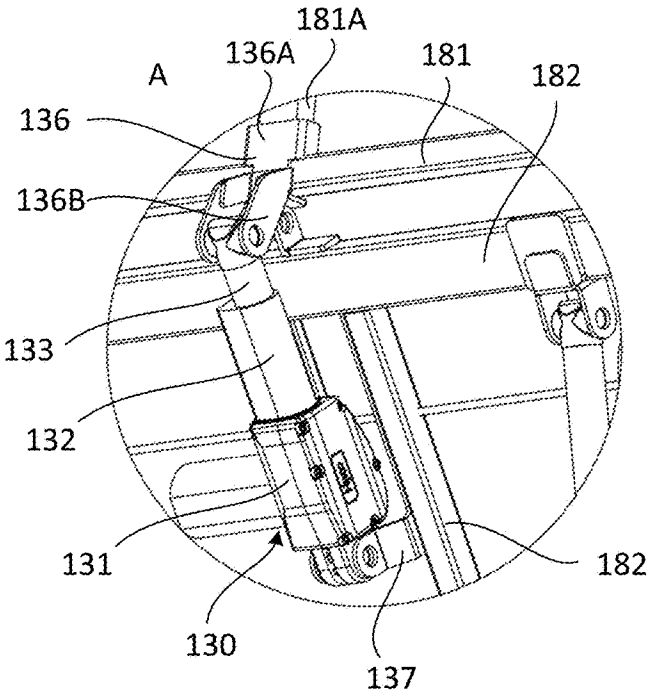
FIG. 3B shows an enlarged view of section A of the multifunctional bed shown in FIG. 3A.
Figure 3A:
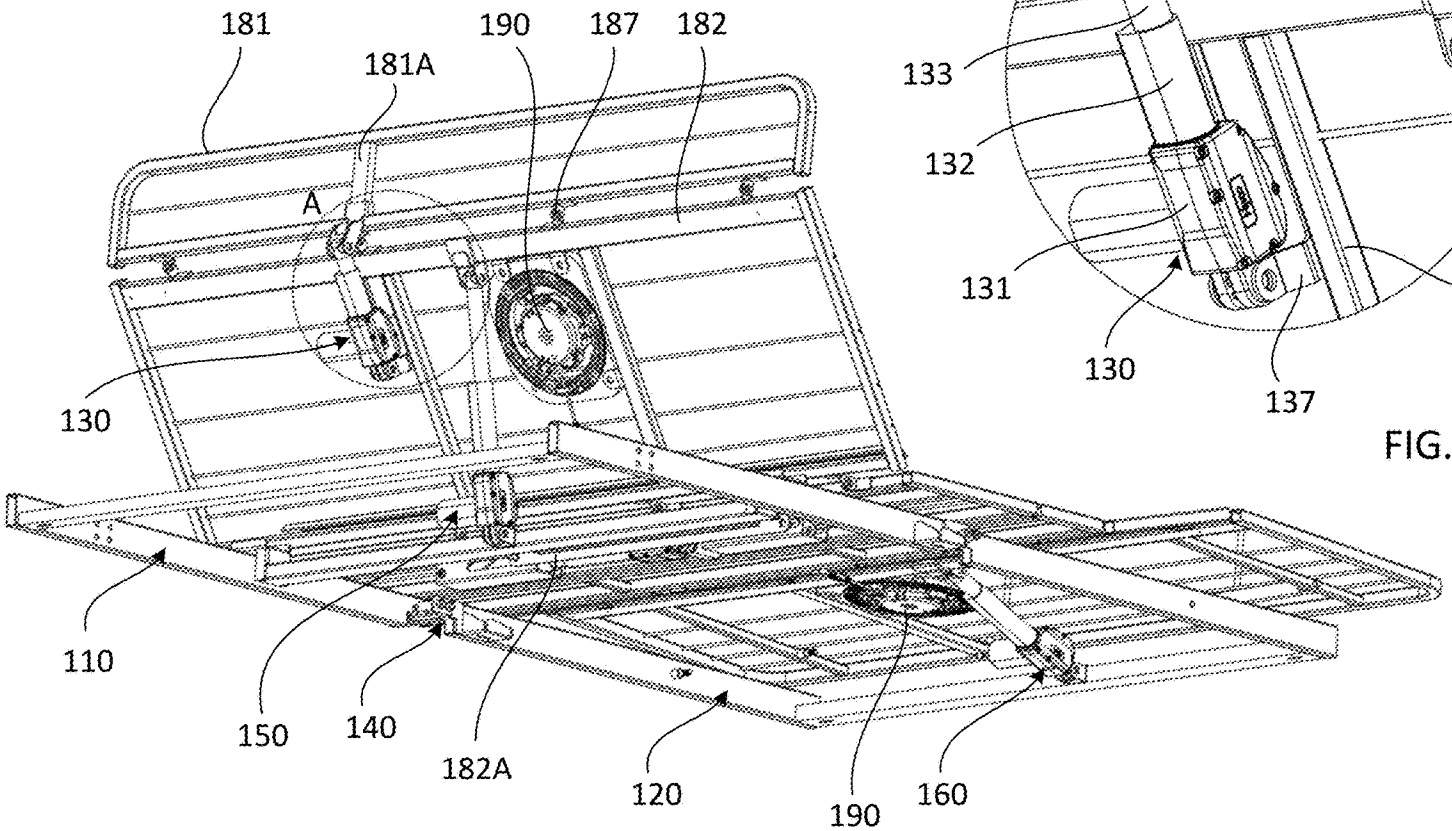
FIG. 3A shows a bottom perspective view of the multifunctional bed shown in FIG. 1.
Figure 4:
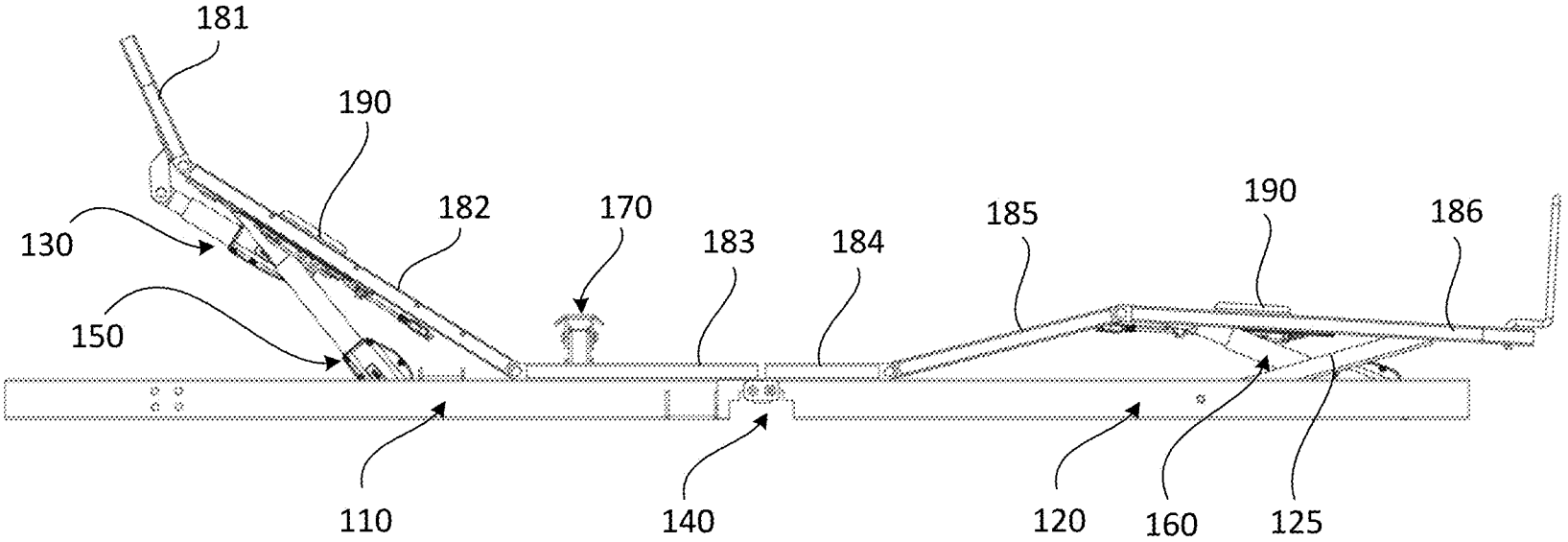
FIG. 4 shows a side view of the multifunctional bed shown in FIG. 1.

It should be noted that, without intent to limit the scope of the invention, the relative terms "upper" and "lower" used in the disclosure refer respectively to a "left" portion/end and a "right" portion/end of an element shown in FIGS. 1 and 3-4, or a "right" portion/end and a "left" portion/end of an element shown in FIGS. 2 and 5A, depending on orientations of the multifunctional bed.

Also referring to FIG. 5A, the first support structure 110 has a length, L1, defined between the upper and lower ends of the pair of first side rails 111 and a width, W1, defined between the two ends of the upper rail 112. The second support structure 120 has a length, L2, defined between the upper and lower ends of the pair of second side rails 121cand a width, W2, defined between the two ends of the lower rail 122. In one embodiment, L2 is less than L1, and W2 is less than W1.

Figure 5B:
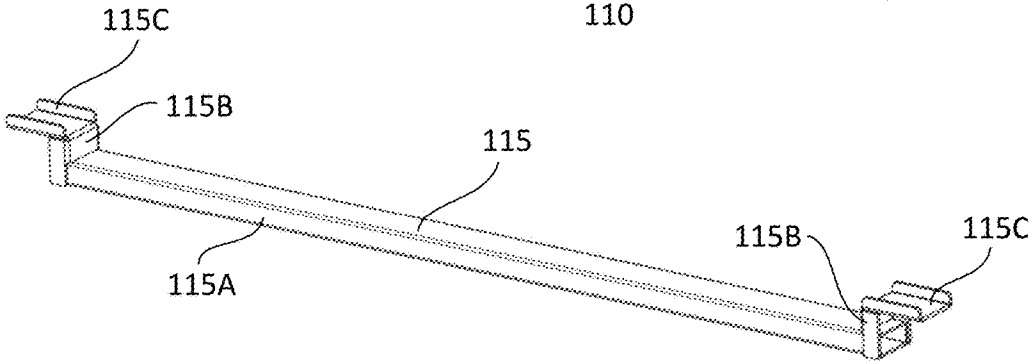
FIG. 5B shows a perspective view of a mounting support bar of the multifunctional bed shown in FIG. 1.
Figures 6A, 6B:
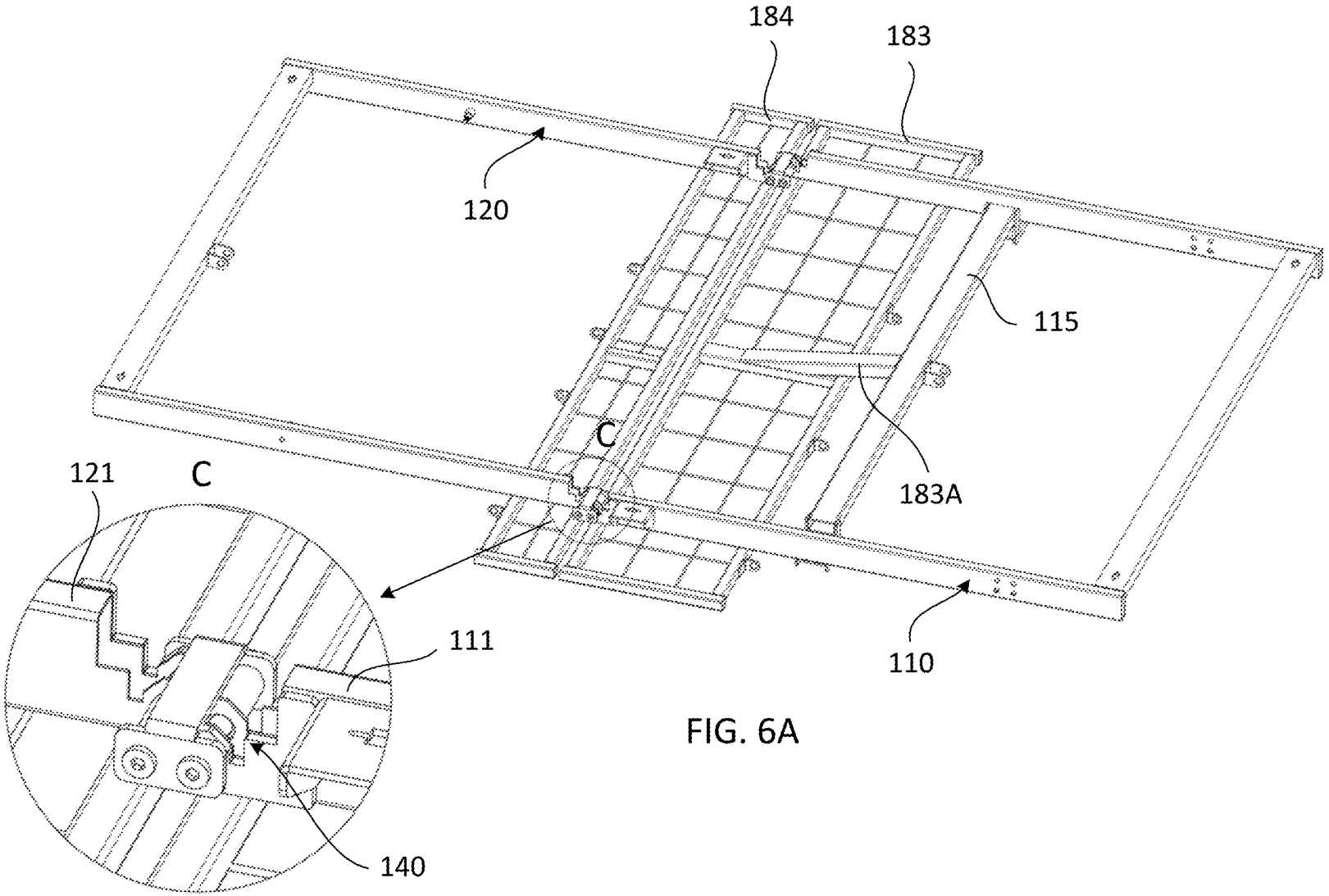
FIG. 6A shows a partially perspective view of the multifunctional bed shown in FIG. 1.
FIG. 6B shows an enlarged view of section C of the multifunctional bed shown in FIG. 6A.
Figure 7:
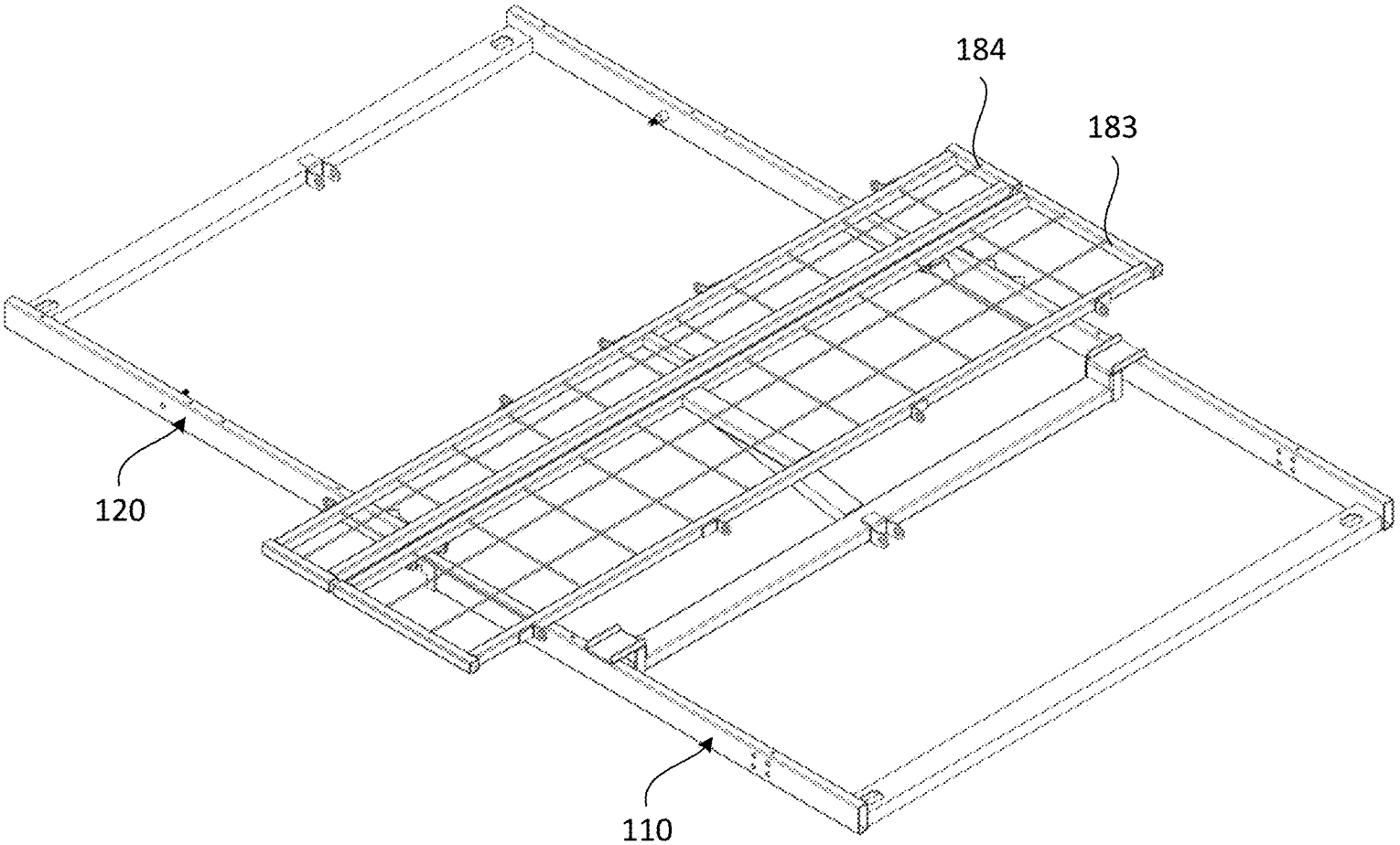
FIG. 7 shows another partially perspective view of the multifunctional bed shown in FIG. 1 in a flat state.
Figure 9:
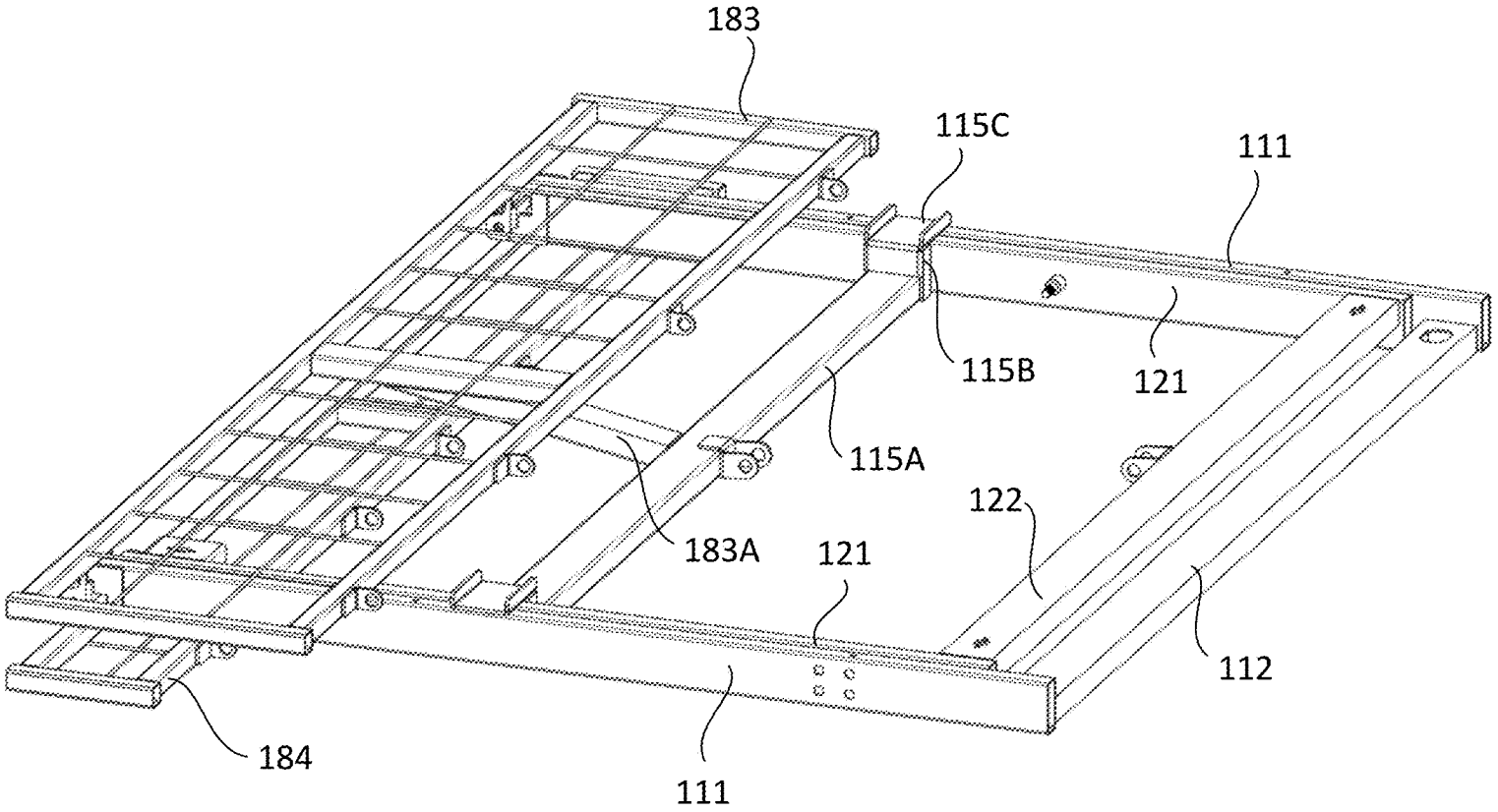
FIG. 9 show another partially perspective view of the multifunctional bed shown in FIG. 1 in the folded state.
Figure 10:
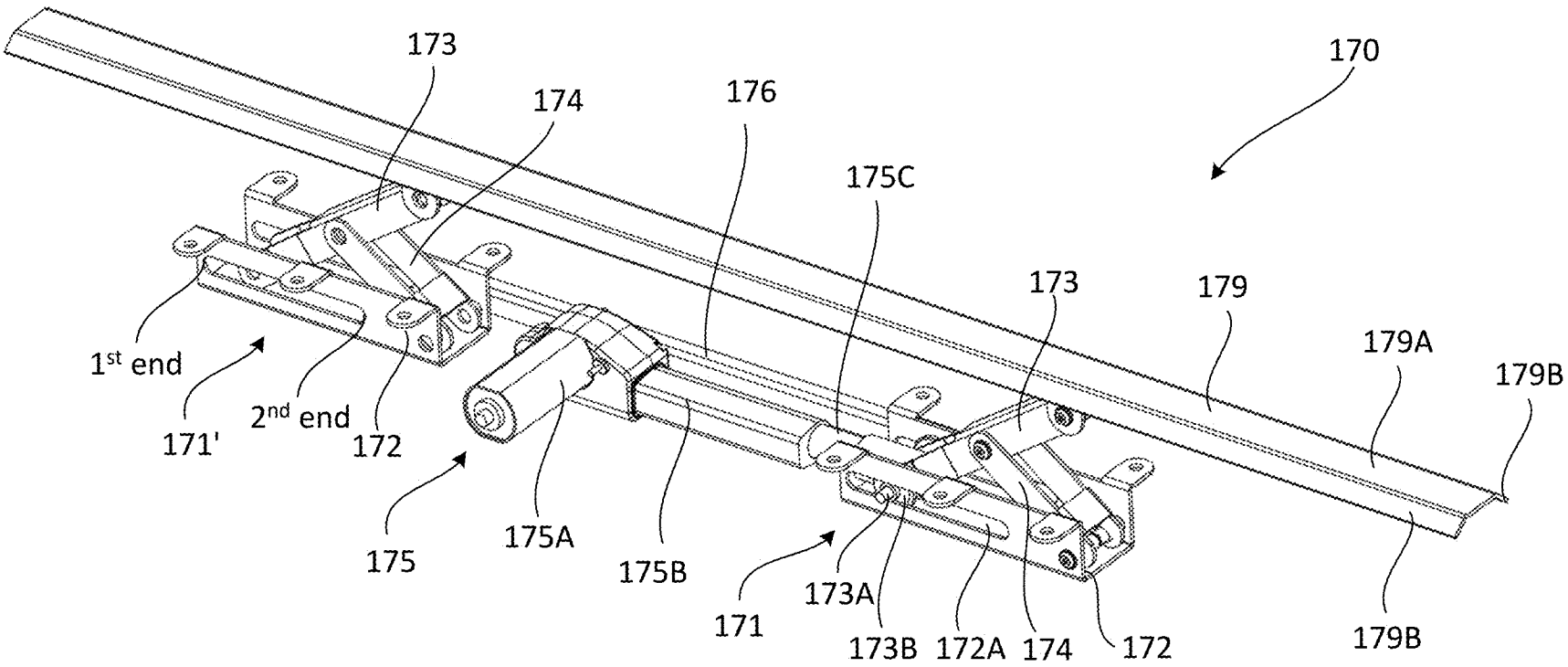
FIG. 10 shows a perspective view of a lumbar support mechanism usable in a multifunctional bed according to one embodiment of the invention.

Referring to FIGS. 5B, the mounting support bar 115 has a bottom portion 115A; a first side tab 115B and a second side tab 115B vertically extended from two opposite ends of the bottom portion, 115A respectively; and a first flange 115C and a second flange 115C vertically extended from free ends of the first side tab 115B and the second side tab 115B, respectively, outwardly along with the bottom portion 115A. As shown in FIG. 6A, the first flange 115C and the second flange 115C are respectively and fixedly connected to the pair of first side rails 111, such that each of the first side tab 115B and the second side tab 115B and the inner side of the corresponding one of the pair of first side rails 111 define a space therebetween. When the first support structure 110 and the second support structure 120 are folded, each of the pair of second side rails 121 of the second support structure 120 is received in the corresponding space, as shown in FIGS. 9-10, thereby reducing the thickness of the folded bed.

Figure 5D:
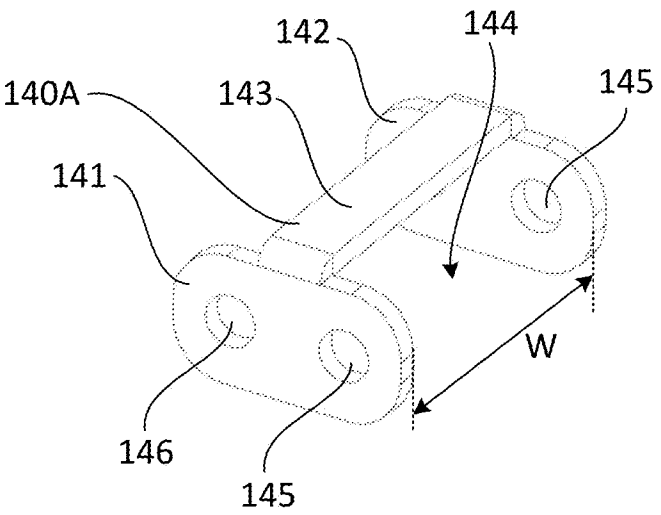
FIG. 5D shows a perspective view of a connection bracket of the multifunctional bed shown in FIG. 1.
Figure 5C:
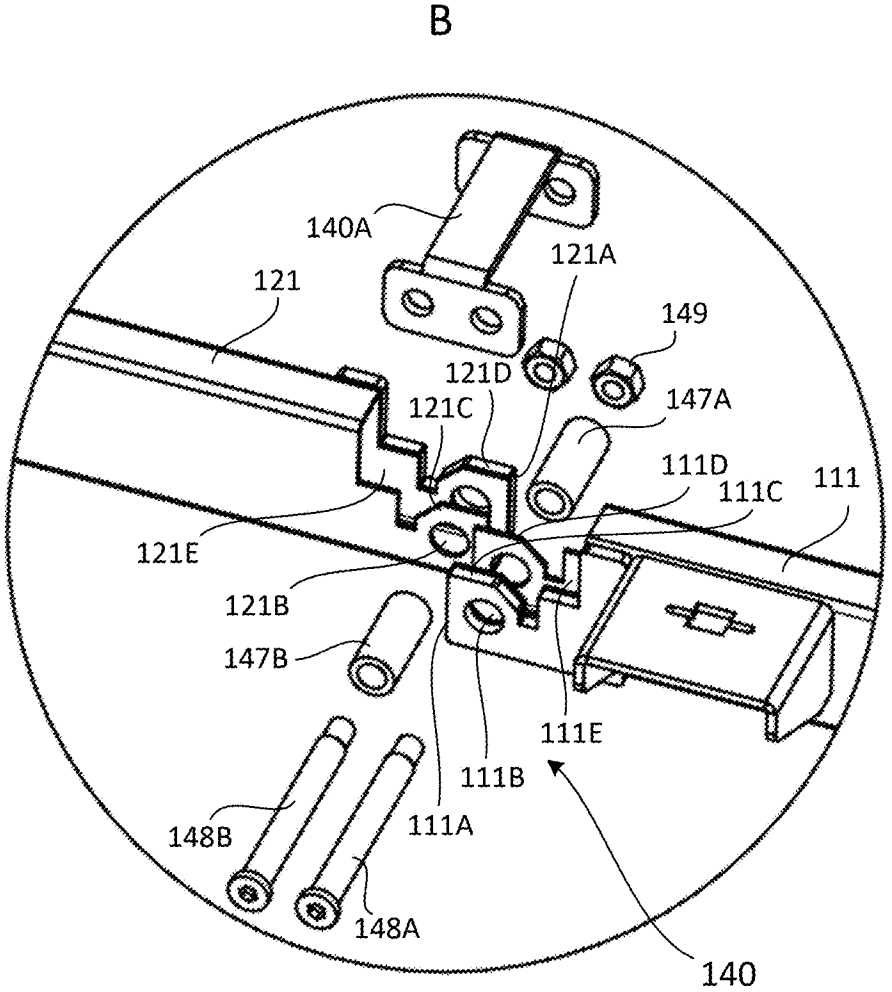
FIG. 5C shows an enlarged view of section B of the support assembly shown in FIG. 5A.

In addition, as shown in FIG. 5C, each of the lower ends 111A of the pair of first side rails 111 and the upper ends 121A of the pair of second side rails 121 has a groove 111E and 121E formed for accommodating each connection mechanism 140.

In some embodiments, each connection mechanism 140 is configured to pivotally connect the lower end of one of the pair of first side rails 111 to the upper end of a corresponding one of the pair of second side rails 121, such that the first support structure 110 and the second support structure 120 are pivotally foldable relative to one another at the pair of connection mechanisms.

In some embodiments, as shown in FIGS. 5C-5D, each connection mechanism 140 comprises a connection bracket 140A having a connection plate 143, and a first side tab 141 and a second side tab 142 vertically extended from two opposite ends of the connection plate 143 so as to define a notched receptacle 144 between the connection plate 143, the first side tab 141 and the second side tab 142. The notched receptacle 144 has a width, W, defined between the first side tab 141 and the second side tab 142. Each of the first tab 141 and the second side tab 142 has a first through hole 145 and a second through hole 146 spatial-apart formed therein.

Referring to FIG. 5C, as assembled, the lower end 111A of the first side rail 111 of the first support structure 110 is received in the notched receptacle 144 of the connection bracket 140A and pivotally connected to the connection bracket 140A through the first through holes 145 of the first and second side tabs 141 and 142 of the connection bracket 140A and the through hole 111B of the lower end 111A of the first side rail 111. The upper end 121A of the second side rail 121 of the second support structure 120 is received in the notched receptacles 144 of the connection bracket 140A and pivotally connected to the connection bracket 140A through the second through holes 146 of the first and second side tabs 141 and 142 of the connection bracket 140A and the through hole 121B of the upper end 121A of the second side rail 121.

In addition, the first and second support sleeves 147A and 147B are provided with each connection mechanism 140.

Specifically, the first support sleeve 147A is disposed between the second side tab 142 of the connection bracket 140A and the inner side 111D of the lower end 111A of the first side rail 111 of the first support structure 110. A first pin 148A is adapted to pass sequentially through the first through hole 145 of the first side tab 141 of the connection bracket 140A, the through hole 111B of the lower end 111A of the first side rail 111, the first support sleeve 147A, and the first through hole 145 of the second side tabs 142 of the connection bracket 140A, and is then secured at the second side tab 142 of the connection bracket 140A, with a nut 149, or other means, e.g., a lock pin. As such, the first side tab 141 of the connection bracket 140A is in contact with the outer side 111C of the lower end 111A of the first side rail 111, while the second side tab 142 of the connection bracket 140A is in contact with one end of the first support sleeve 147A. Preferably, the sum of the width of the lower end 111A of the first side rail 111 and the length of the first support sleeve 147A is substantially same as or very slightly less than the width W of the notched receptacles 144 of the connection bracket 140A, such that the notched receptacles 144 of the connection bracket 140A can accommodate the lower end 111A of the first side rail 111 and the first support sleeve 147A tightly therein, but still allows the lower end 111A of the first side rail 111 to rotate around the first pin 148A.

The second support sleeve 147B is disposed between the first side tab 141 of the connection bracket 140A and the outer side 121C of the upper end 121A of the second side rail 121 of the second support structure 120. A second pin 148B is adapted to pass sequentially through the second through hole 146 of the first side tabs 141 of the connection bracket 140A, the second support sleeve 147B, the through hole 121B of the upper end 121A of the second side rail 121, and the second through hole 146 of the second side tabs 142 of the connection bracket 140A, and is then secured at the second side tab 142 of the connection bracket 140A, with a nut 149, or other means, e.g., a lock pin. As such, the first side tab 141 of the connection bracket 140A is in contact with one end of the second support sleeve 147B, while the second side tab 142 of the connection bracket 140A is in contact with the inner side 121D of the upper end 121A of the second side rail 121. Preferably, the sum of the width of the upper end 121A of the second side rail 121 and the length of the second support sleeve 147B is substantially same as or very slightly less than the width W of the notched receptacles 144 of the connection bracket 140A, such that the notched receptacles 144 of the connection bracket 140A can accommodate the upper end 121A of the second side rail 121 and the second support sleeve 147B tightly therein, but still allows t the upper end 121A of the second side rail 121 to rotate around the second pin 148B.

Similarly, another first side 112 of the first support structure 110 is pivotally connected with another second side rail 122 of the second support structure 120 through another one of the pair of connection mechanisms 140.

By using the pair of connection mechanisms 140 to connect the first and second support structures 110 and 120, the first support structure 110 and the second support structure 120 are foldable to each other in a lower space below the plurality of platforms 181-186, while either the first support structure 110 or the second support structure 120 cannot rotate or be folded in an upper space above the plurality of platforms 181-186 since the connection plate 143 of each connection bracket 140A functions as a rotation limitation to prevent each of the first support structure 110 and the second support structure 120 from rotating toward the upper space above the plurality of platforms 181-186.

Figure 8:
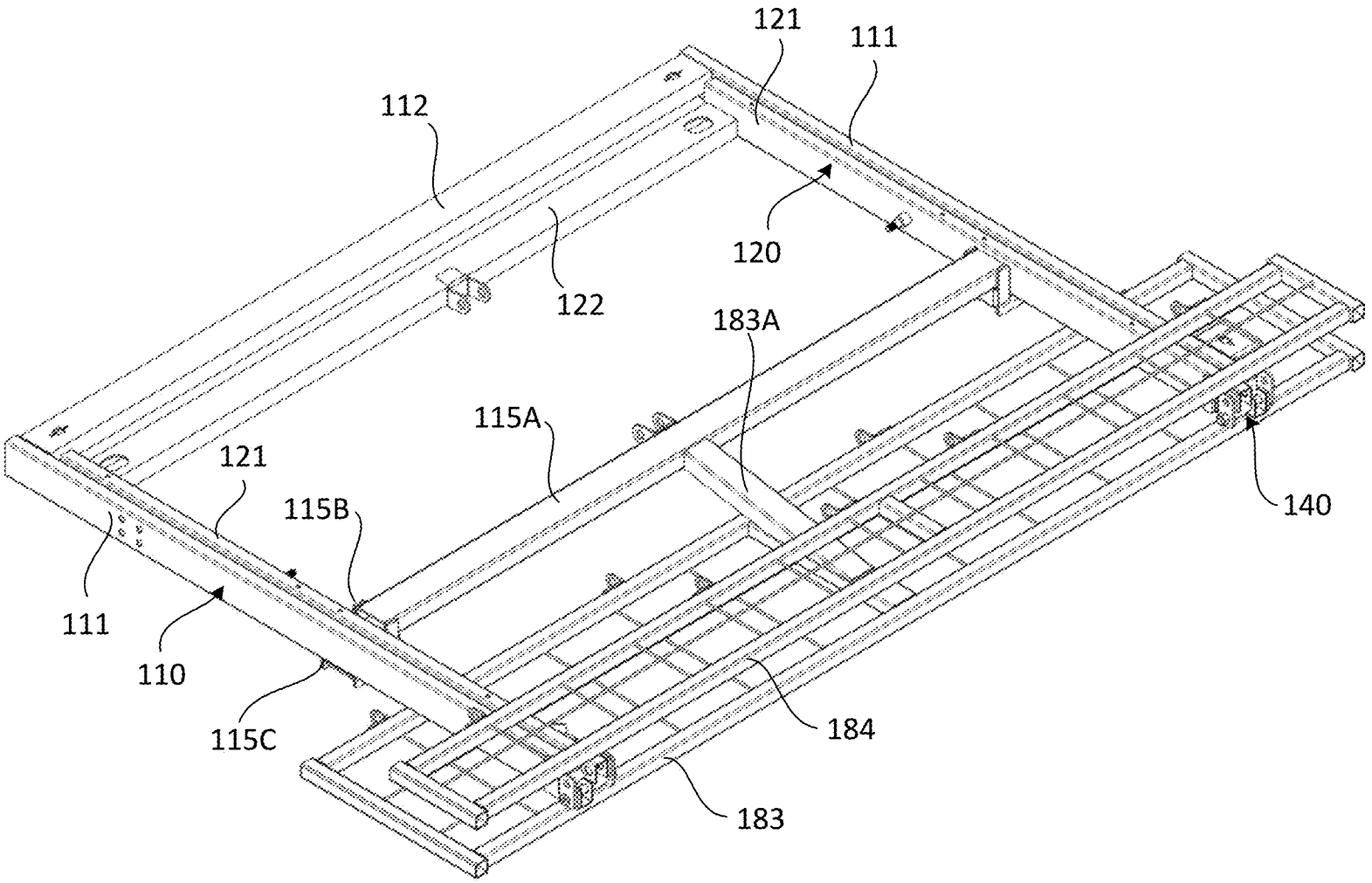
FIG. 8 show a partially perspective view of the multifunctional bed shown in FIG. 1 in the folded state.

In addition, the pair of second side rails 121 of the second support structure 120 is aligned between the pair of first side rails 111 of the first support structure 110, as shown in FIG. 5A. When folded, each of the pair of second side rails 121 of the second support structure 120 is received in the corresponding space defined between the inner side of the first side rails 111 and the side tab 115B of the mounting support bar 115 of the first support structure 110, and the second support structure 120 is aligned inside the first support structure 110, thereby reducing the thickness of the folded bed, as shown in FIGS. 8-9.

In some embodiments, the multifunctional bed further comprises a plurality of mounting seats 101 attached to the first support structure 110 and the second support structure 110, each mounting seat 101 has a mounting hole formed therein. The mounting seat 101 may be used to support bed posts or bed legs (not shown).

As shown in FIGS. 1-2, 3A and 4, the plurality of platforms includes a head platform 181, a back platform 182, a first seat platform 183, a second seat platform 184, a thigh platform 185 and a leg platform 186, each of which has a lower edge and an upper edge. The head platform 181 is pivotally connected to the upper edge of the back platform 182. The first seat platform 183 is fixedly attached to a lower portion of the pair of the first side rails 111 of the first support structure 110 and the second seat platform 184 is fixedly attached to an upper portion of the pair of the second side rails 121 of the second support structure 120 such that the lower edge of the first seat platform 183 is adjacent to the upper edge of the second seat platform 184. The lower edge of the back platform 182 is pivotally connected to the upper edge of the first seat platform 183 through hinges 187. The upper edge of the thigh platform 185 is pivotally connected to the lower edge of the second seat platform 184 through hinges 187. The upper edge of the leg platform 186 is pivotally connected to the lower edge of the thigh platform 185 through hinges 187.

In addition, the second support structure 120 further comprises a pair of leg support bars 125. Each leg support bar 125 has one end pivotally connected to one of the pair of second side rails 121 at its lower portion 121F, and another end pivotally connected to the leg platform 186.

In some embodiments, a reinforcement bar 183A is provided on an underneath surface of the first seat platform 183 and is connected to the mounting support bar 115 of the first support structure 110, as shown in FIG. 6A.

In some embodiments, each of the plurality of platforms is a solid broad (not shown), or a frame, or a net-like frame, as shown in FIGS. 1-2 and 3A. The net-like frame can be a frame with threads or ropes crossly connected to the frame.

Furthermore, the multifunctional bed also includes a back lifting actuator 150 pivotally connected between the mounting support bar 115 of the first support structure 110 and the back platform 182 for operably driving the back platform 182 to pivotally move in an upward rotating direction or a downward rotating direction relative to the first support structure 110. Specifically, as shown in FIGS. 2 and 5A, the back lifting actuator 150 comprises a motor member 151, an outer tube 152 extending from the motor member 151, and an activation rod 153 having a first end portion received in the outer tube 151 and an opposite, second end portion. The activation rod 153 is engaged with the motor member 151 and configured to be telescopically movable relative to the outer tube 152 according to a direction of motor rotation. In one embodiment, the motor member 151 is pivotally connected to the mounting support bar 115 of the first support structure 110 through a mounting bracket 115D and the second end portion of the activation rod 153 pivotally connected to the back platform 182 through a mounting bracket 182D on a reinforcement bar 182A formed on the underneath surface of the back platform 182. In another embodiment, the motor member 151 is pivotally connected to the back platform 182 through the mounting bracket 182D on the reinforcement bar 182A formed on the underneath surface of the back platform 182 and the second end portion of the activation rod 153 pivotally connected to the mounting support bar 115 of the first support structure 110 through the mounting bracket 115D.

By using the back lifting actuator 150, the position and angle of the back platform 182 can be adjusted according to the user's preference. For example, when the activation rod 153 is driven by the motor member 151 from a retracted state to an extended state, the back platform 182 rotates around the pivot at hinges 187 accordingly to lift up the back platform 182 from a flat position to an adjusted position (FIG. 1). Otherwise, when the activation rod 153 is driven by the motor member 151 from the extended state to the retracted state, the back platform 182 rotates around the pivot at hinges 187 accordingly to put down the back platform 182 from the adjusted position to the flat position.

In addition, as shown in FIGS. 2 and 3A-3B, the multifunctional bed further includes a head platform tilting actuator 130 pivotally and directly connected to the head platform 181 and the back platform 182 for operably adjusting the head platform 181 in a tilting position or a flat position relative to the back platform 182.

Referring to FIG. 3B, the head platform tilting actuator 130 comprises a motor member 131, an outer tube 132 extending from the motor member 131, an activation rod 133 received in the outer tube 132, engaged with the motor member 131 and configured to be telescopically expandable or contractible relative to the outer tube 132 according to a direction of motor rotation. The motor member 131 is pivotally connected to the back platform 182 by a back platform mounting bracket 137 that is directly mounted on the back platform 182. The activation rod 133 has a distal end portion pivotally connected to the head platform 181 by a head platform mounting bracket 136. The head platform mounting bracket 136 has a reinforcement angle bracket 136A mounted onto a lower edge portion of the head platform 181 and a head mounting bracket 136B protruded from the reinforcement angle bracket 136A and pivotally connected the distal end portion of the activation rod 133.

Moreover, the multifunctional bed also includes a leg lifting actuator 160 pivotally connected between the second support structure 120 and the leg platform 186 for operably driving the leg platform 186 to pivotally move in an upward rotating direction or a downward rotating direction relative to the second support structure 186.

Referring to FIGS. 1 and 5A, the leg lifting actuator 160 comprises a motor member 161, an outer tube 162 extending from the motor member 161, and an activation rod 163 having a first end portion received in the outer tube 162 and an opposite, second end portion. The activation rod 163 is engaged with the motor member 161 and configured to be telescopically movable relative to the outer tube 162 according to a direction of motor rotation. In one embodiment, the motor member 161 is pivotally connected to the lower rail 122 of the second support structure 120 through a mounting bracket 122D and the second end portion of the activation rod 163 is pivotally connected to the leg platform 186 through a mounting bracket 186D on a reinforcement bar 186A formed on the underneath surface of the leg platform 186. In another embodiment, the motor member 161 is pivotally connected to the leg platform the leg platform 186 through the mounting bracket 186D on the reinforcement bar 186A formed on the underneath surface of the leg platform 186 and the second end portion of the activation rod 163 is pivotally connected to the lower rail 122 of the second support structure 120 through the mounting bracket 122D.

By using the leg lifting actuator 160, the position and angle of the thigh and leg platforms 185 and 186 can be adjusted according to the user's preference. For example, when the activation rod 163 is driven by the motor member 161 from a retracted state to an extended state, the leg platform 186 moves up accordingly and in turn, lifts up the thigh platform 185 from a flat position (not shown) to an adjusted position (FIG. 4). Otherwise, when the activation rod 163 is driven by the motor member 161 from the extended state to the retracted state, the leg platform 186 moves down accordingly, and in turn, puts down the thigh platform 185 from the adjusted position to the flat position.

Referring to FIGS. 1, 4 and 10-12, the multifunctional bed in one embodiment of the invention also includes a lumbar support mechanism 170 operably supported by the first support structure 110 for operably providing lumbar support to the user of the bed.

Figure 11:
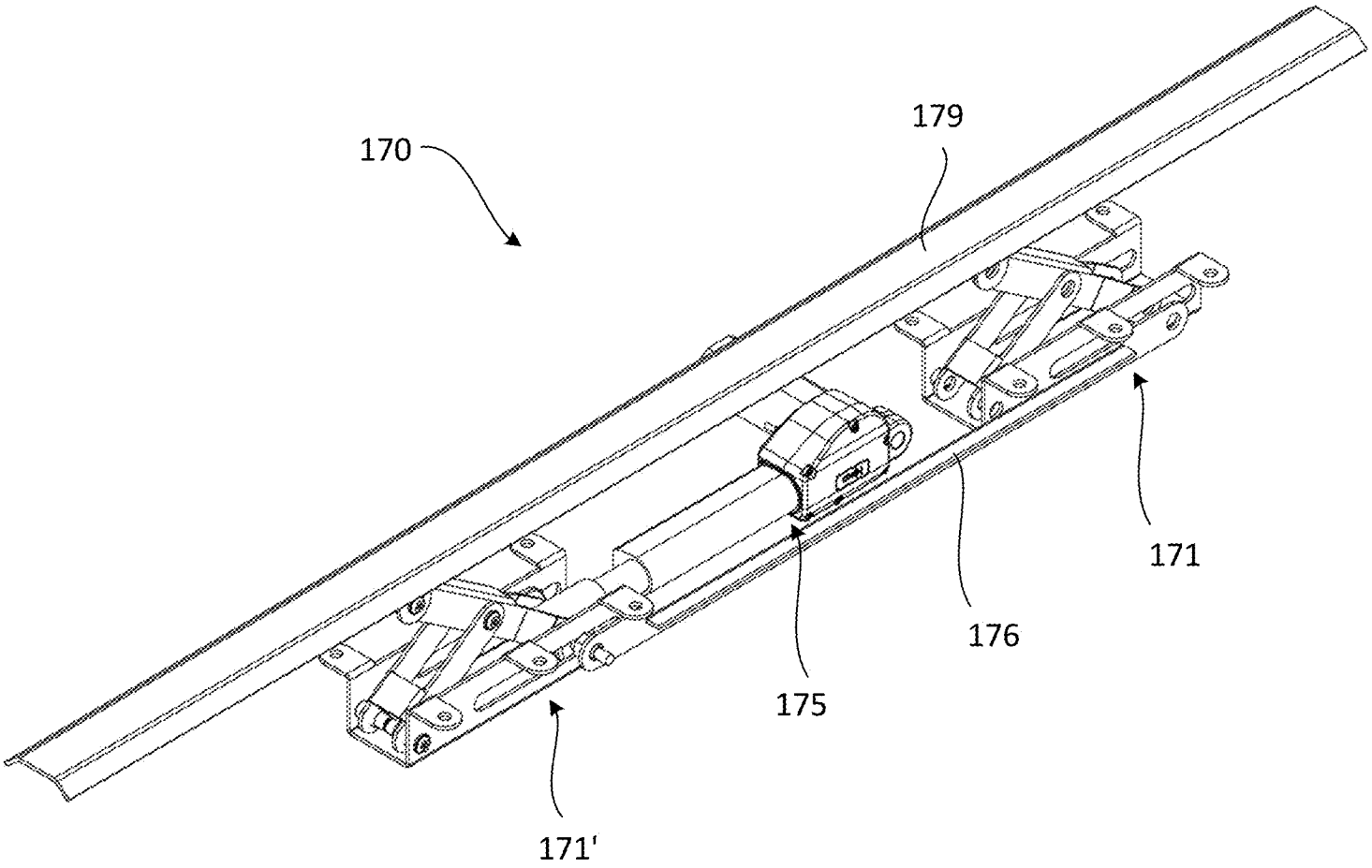
FIG. 11 shows another perspective view of the lumbar support mechanism shown in FIG. 10.
Figure 12:
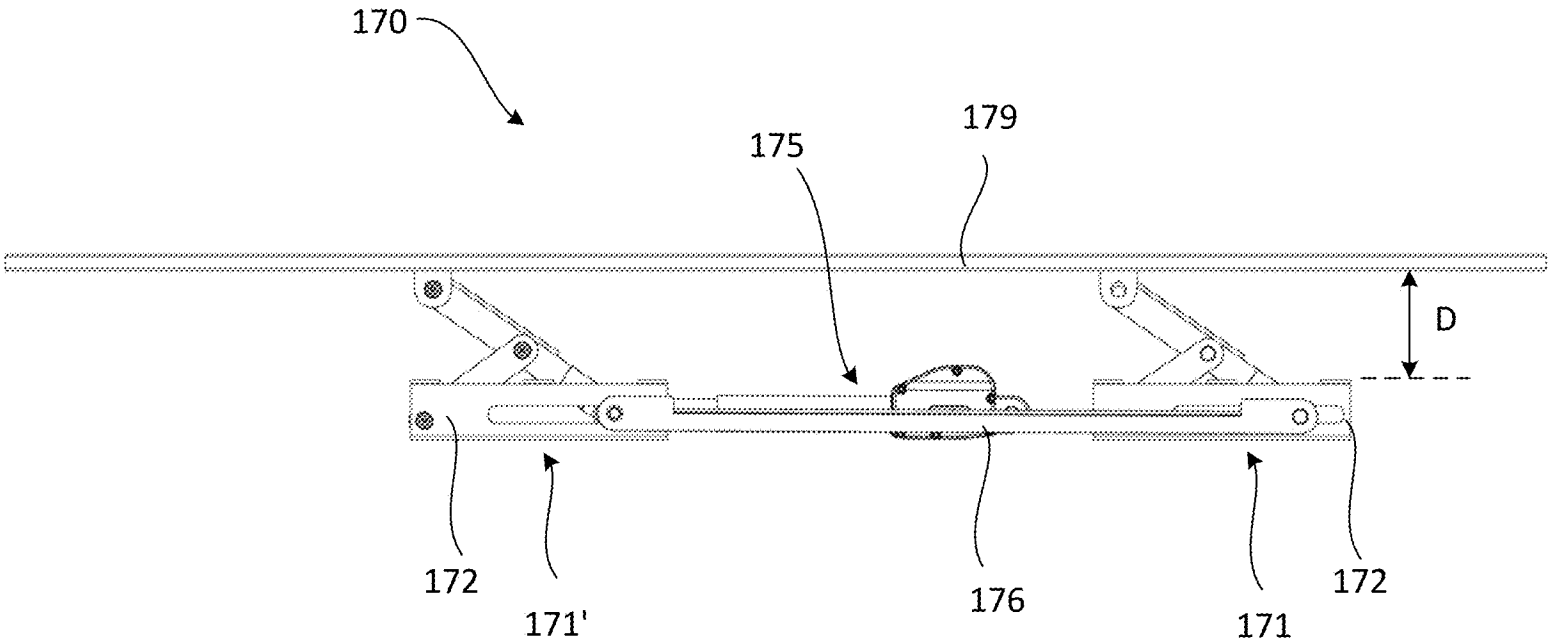
FIG. 12 shows a side view of the lumbar support mechanism shown in FIG. 10.

As particularly shown in FIGS. 10-12, the lumbar support mechanism 170 comprises a first lumbar lifting assembly 171, a second lumbar lifting assembly 171', a lumbar support actuator 175, a linkage member 176, and a lumbar support member 179.

The first lumbar lifting assembly 171 and the second lumbar lifting assembly 171' can be identical or substantially different. The following description illustrates the embodiment of which the first and second lumbar lifting assemblies 171 and 171' are identical. The same principles apply in the different first and second lumbar lifting assemblies.

Each of the first and second lumbar lifting assemblies 171 and 171' has a fixing bracket 172, a long leg 173, and a short leg 174. The fixing bracket 172 is operably attached to the first support structure 110. The long leg 173 has an upper end pivotally connected to the lumbar support member 179, and a lower end operably movable in the fixing bracket 172 and pivotally connected to the linkage member 176. The short leg 174 has an upper end pivotally connected to a middle portion of the long leg 173, and a lower end pivotally connected to the fixing bracket 1173. As such, the distance between the lumbar support member 179 and the linkage member 176 is changeable between a minimal distance and a maximal distance when the linkage member 176 moves between a first position and a second position.

In some embodiments, each fixing bracket 172 has a guiding slot 172A having first and second ends. The guiding slot 172A is configured to moveably receive a guiding pin or shaft 173A that pivotally connects the lower end of the long leg 173 to the linkage member 176, such that when the guiding pin or shaft 173A moves to the first end of the guiding slot 172A, the linkage member 176 moves to the first position, and when the guiding pin or shaft 173A moves to the second end of the guiding slot 172A, the linkage member 176 moves to the second position.

In one embodiment, each of the first and second lumbar lifting assemblies 171 and 171' further comprises a bearing member 173B accommodated and operably movable in the fixing bracket 172. The bearing member 173B is pivotally connected to the lower end of the long leg 173.

In some embodiments, the bearing member comprises at least one sliding block.

In other embodiments, the bearing member comprises at least one roller 173B pivotally connected to the lower end of the long leg 172 and the linkage member 176 by the guiding pin or shaft 173A that is movably received in the guiding slot 172 of the fixing bracket 171, such that when the lower end of the long leg 173 is driven to move in the fixing bracket 172, the guiding pin or shaft 173A moves along the guiding slot 172 of the fixing bracket 171 and the at least one roller 173B rotates on a bottom wall of the fixing bracket 172. In some embodiment, the bearing member 173B is designed such that the rollers 173B can bear all or some of the force or weight exerted on the lower end portion of the long leg 173 during operations of the lumbar support mechanism.

As shown in FIGS. 10-12, the lumbar support member 179 is connected to the lifting support brackets 172 of the first and second lumbar lifting assembles 171 and 171'. The linkage member 176 is pivotally connected to the bearing members 173B of first and second lumbar lifting assembles 171 and 171'.

As such, the distance, D, between the lumbar support member 179 and the lifting support brackets 172 of the first and second lumbar lifting assembles 171 and 171' is operably changeable between a minimal distance and a maximal distance when the linkage member 176 moves between a first position and a second position. In other words, the lumbar support member 179 is operably movable between a retracted position and an ejected (expanded) position when the linkage member 176 moves between the first and second positions. The lumbar support is provided when the lumbar support member 179 is in the ejected position.

Specifically, two end portions of the linkage member 176 are pivotally connected to the shafts (i.e., 173A) of the bearing members 173B of the first lumbar lifting assembly 171 and the second lumbar lifting assembly 171', respectively. When the shaft 173A moves to the first end of the at least one guiding slot 172, the linkage member 176 moves to the first position and the lumbar support member 179 is in the retracted position, where the distance between the lumbar support member 179 and the lifting support brackets 171 is the minimal distance. When the shaft 173A moves to an opposite, second end of the at least one guiding slot 172, the linkage member 176 moves to the second position and the lumbar support member 179 is in the ejected position, where the distance between the lumbar support member 179 and the lifting support brackets 171 is the maximal distance.

In some embodiments as shown in FIG. 10, the lumbar support member 179 includes a flat plate section 179A located in the middle and two inclined plate sections 179B respectively extended from both sides of the flat plate section 179A. Each of the inclined plate section 179B is inclined gradually downward from the joint of the inclined plate section 179B and the flat plate section 179A. The gradually inclined profile of the lumbar support member 179 improves user comfort.

In one embodiment, the lumbar support mechanism further comprises a lumbar support actuator 175 operably connected to the lower end of the long leg 173 of one of the first lumbar lifting assembly 171 and the second lumbar lifting assembly 171' for operably moving the linkage member 176 between the first position and the second position.

The lumbar support actuator 175 comprises a motor member 175A, an outer tube 175B extending from the motor member 175A, and an activation rod 175C received in the outer tube 175B, engaged with the motor member 175A and configured to be telescopically movable relative to the outer tube 175B according to a rotation direction of the motor member 175A. A distal (free) end of the activation rod 175C is pivotally connected to the lower end portion of the long leg 173, or pivotally connected to the shaft 173A of the bearing members 173B of the first lumbar lifting assembly 171. In other embodiments, the activation rod 175C can also be driven by hydraulic pressure or pneumatic pressure. The lumbar support actuator 175 also comprises a mounting bracket connected to the motor member 175A for securing the lumbar support actuator 175 onto the first support structure 110.

When the motor member 175A drives the activation rod 175C to make an extension motion, the extension motion drives the lower end portion of the long leg 173 and thus the shaft 173A to move forward, i.e., a direction of which the shaft 173A moves in the guiding slot 172 from the first end to the second end. The roller 173B rolls on the fixing bracket 172, and at the same time, the linkage member 176 drives the long leg 173 of the second lifting assembly 171' to move synchronously with the long leg 173 of the first lifting assembly 171, then the upper ends of the long legs 173 of the first lifting assembly 171 and the second lifting assembly 171' are both lifted upward, and the lumbar support member 179 pivotally connected to the upper ends of the long legs 120 is lifted upward accordingly. When the driving motor 175A is stopped, the lumbar support member 179 is supported by the rollers 173B at the lower end of the long leg 173 and the lower end of the short leg 174 of the first and second lifting assemblies 171 and 171'. During this process, the rolling of the rollers 173B of the long leg 173 makes the lumbar support member 179 rise smoothly, and the rollers 173B at the lower end of the long leg 173 and the lower end of the short leg 174 support the upper lumbar support member 179. This can reduce the damage to the guiding slot edge of the fixing bracket 172 and the shaft 173A in the lifting assemblies 171 and 171', prolong the life of the lifting assembly, and reduce the maintenance frequency of the lumbar support mechanism.

Referring to FIGS. 1-2, 3A, 4 and 13-15, the multifunctional bed further comprises one or more massage devices 190 spatial-separately installed on the plurality of platforms 181-186. In one embodiment, the one or more massage devices are operable individually or cooperatively. The one or more massage devices are operable with a remote control, and/or a smart mobile device.

Figure 13:
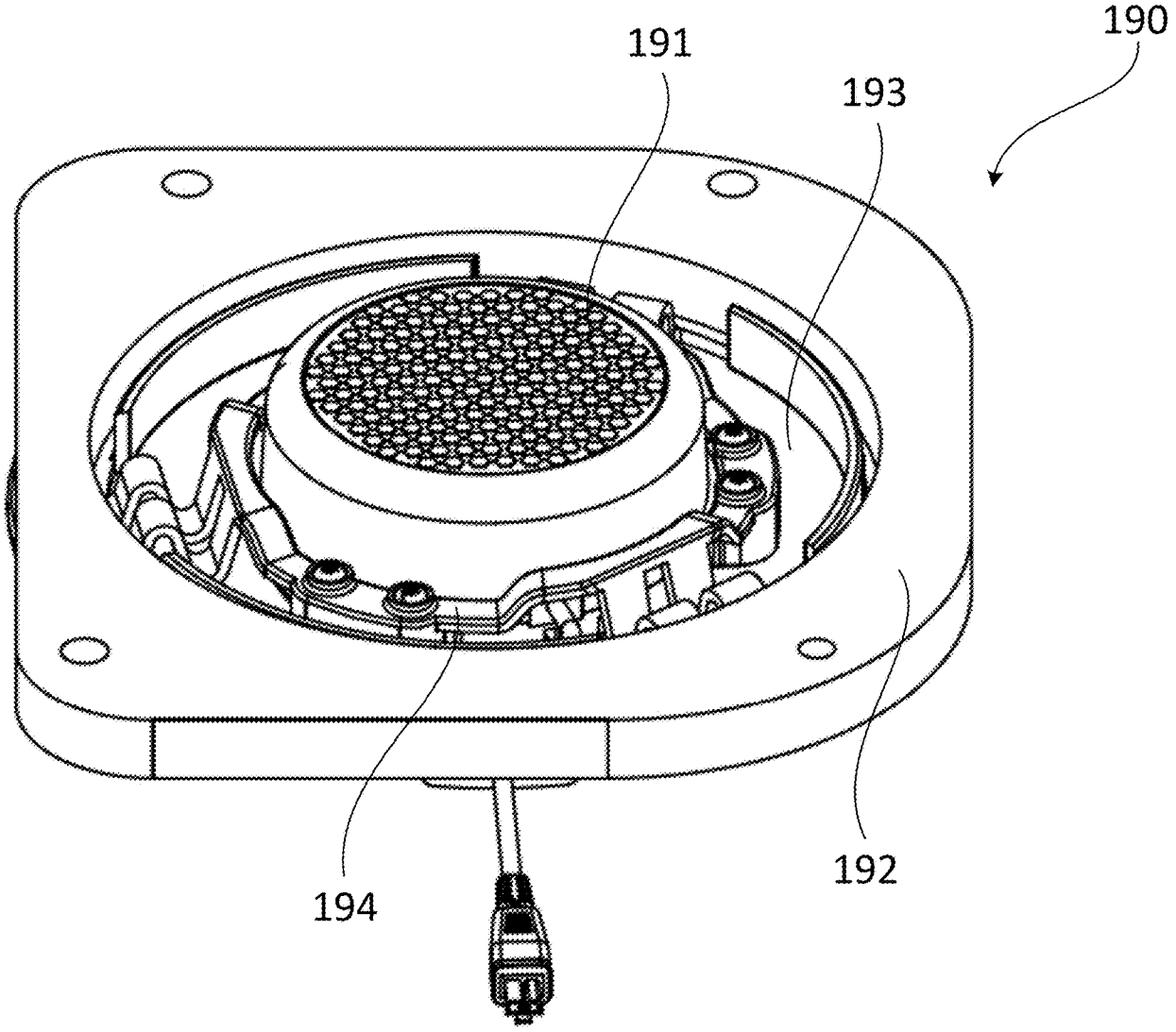
FIG. 13 shows a perspective view of a massage device usable in a multifunctional bed according to one embodiment of the invention.
Figure 14:
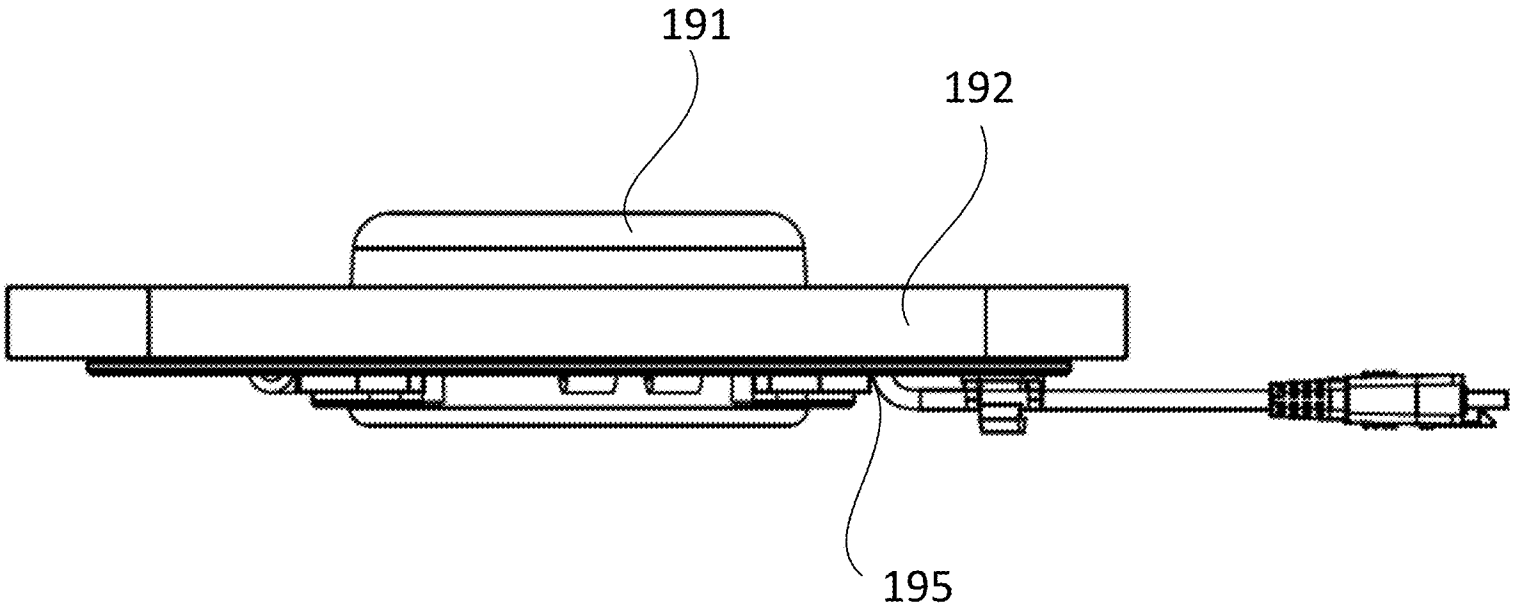
FIG. 14 shows a side view of the massage device shown in FIG. 13.
Figure 15:
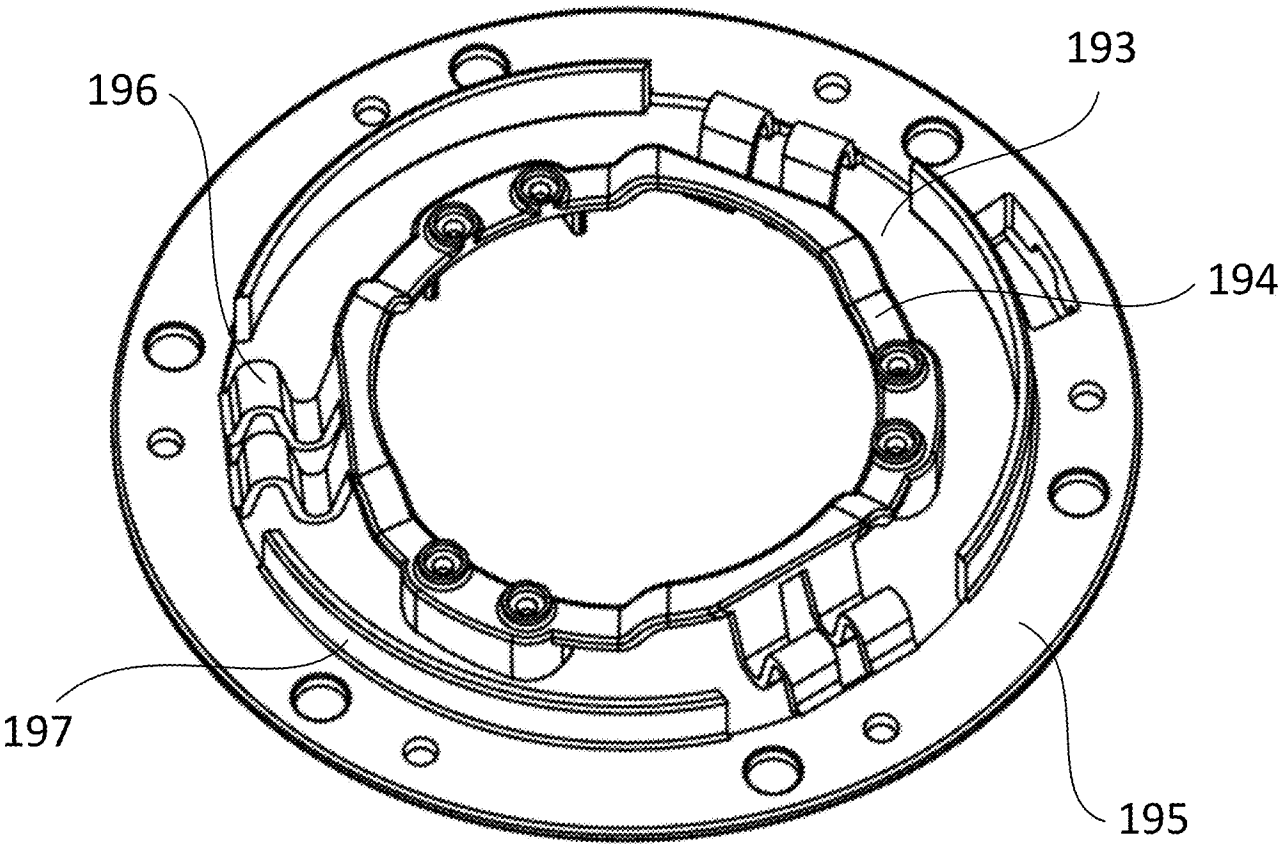
FIG. 15 shows a partially perspective view of the massage device shown in FIG. 13.

As shown in FIGS. 13-15, in one embodiment, each massage device 190 comprises a casing 192 mounted onto a respective platform, e.g., the back platform 182, or the leg platform 186 shown in FIG. 1. Each massage device 190 also comprises a sonic vibrator 191, and a vibrator accommodating member received in a cavity 193 of the casing 192 and fixed to the casing 192. The vibrator accommodating member comprises an inner plate 194 having an opening defined in the middle for accommodating the sonic vibrator 191 therein, and an outer plate 195 spatially surrounding the inner plate 194 and connected to the inner plate 194 by a plurality of elastic connectors 196. The outer plate 195 is then fixed to the casing 192, for example, by bolts.

In one embodiment, each elastic connector 196 is formed in an S shape and has one end connected to the inner plate 194 and the other end connected to the outer plate 195, such that the inner plate is operably vibrable relative to the outer plate 195. The design of the S-shaped elastic connector 196 not only meets the fixing requirements when the inner mounting plate 194 and the outer mounting plate 195 are fixed, but also enables the inner mounting plate 194 to vibrate/shake relative to the outer mounting plate 195, providing a good foundation for the subsequent good vibration of the sonic vibrator 191.

As shown in FIG. 13, in one embodiment, a number of positioning plates 197 are arranged in an angular shape on the outer plate 195. The positioning plates 197 are arc-shaped plates and are vertically protruded from the inner edge of the outer plate 195. The design of the positioning plates 197 allows the outer plate 195 to be quickly positioned relative to the vibrator mounting casing 192 when being fixed to the vibrator mounting casing 192, thereby realizing the rapid installation of the outer mounting plate 195.

The design of the massage device 190, with the cooperation of the music/sonic vibrator 191, can achieve both vibration massage and music playback, and realize more functions; and for the installation of the music vibrator 191, the cooperation of the inner mounting plate 194, the outer mounting plate 195 and the elastic connectors 196 is adopted, which not only meets the installation requirements of the music vibrator, but also ensures that the music vibrator can vibrate to the maximum extent, avoids affecting the vibration amplitude of the music vibrator due to the fixed connection, and ensures that it can provide users with a good massage experience.

In addition, the operations of the music vibrators 190, the back lifting actuator 150, the head lifting actuator 170, and the leg lifting actuator 160 of the bed can be initiated and individually or cooperatively controlled by a remote control, or an application (APP) using in smart mobile devices, such as smart phones, smart watches, tablets, or the likes.

In sum, the invention provides a bed system capable of adjusting body positions, providing vibration massage effects, and playing to music, based on user's preference so that the user achieves maximum comfort during sleep, and also is foldable so as to reduce the space for storage and transportation.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A multifunctional bed, comprising:

a support assembly comprising a first support structure and a second support structure foldably connected to the first support structure through a pair of connection mechanisms;

a plurality of platforms disposed on the support assembly;

a lifting mechanism positioned between the frame assembly and the plurality of platforms for operably adjusting positions of at least one of the plurality of platforms so as to adjust the multifunctional bed at a desired position; and a lumbar support mechanism supported by the support assembly for operably providing lumbar support, wherein the lumbar support mechanism comprises:

a lumbar support member;

a linkage member; and a first lumbar lifting assembly and a second lumbar lifting assembly, each of the first and second lumbar lifting assemblies comprising a fixing bracket, a long leg, a short leg, wherein the fixing bracket is operably supported by the support assembly; the long leg has an upper end pivotally connected to the lumbar support member, and a lower end operably movable in the fixing bracket and pivotally connected to the linkage member; and the short leg has an upper end pivotally connected to a middle portion of the long leg, and a lower end pivotally connected to the fixing bracket, such that a distance between the lumbar support member and the linkage member is changeable between a minimal distance and a maximal distance when the linkage member moves between a first position and a second position.

2. The multifunctional bed of claim 1, wherein the fixing bracket has a guiding slot having first and second ends, the guiding slot being configured to moveably receive a guiding pin that pivotally connects the lower end of the long leg to the linkage member, such that when the guiding pin moves to the first end of the guiding slot, the linkage member moves to the first position, and when the guiding pin moves to the second end of the guiding slot, the linkage member moves to the second position.

3. The multifunctional bed of claim 2, wherein each of the first and second lumbar lifting assemblies further comprises a bearing member accommodated and operably movable in the fixing bracket, the bearing member being pivotally connected to the lower end of the long leg.

4. The multifunctional bed of claim 1, wherein the lumbar support mechanism further comprises a lumbar support actuator operably connected to the lower end of the long leg of one of the first lumbar lifting assembly and the second lumbar lifting assembly for operably moving the linkage member between the first position and the second position.

5. The multifunctional bed of claim 1, further comprising one or more massage devices spatial-separately installed on the plurality of platforms.

6. The multifunctional bed of claim 1, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails.

7. The multifunctional bed of claim 6, wherein each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein, wherein the notched receptacle has a width defined between the first side tab and the second side tab.

8. The multifunctional bed of claim 7, wherein each of the lower ends of the pair of first side rails and the upper ends of the pair of second side rails has a groove formed for accommodating the connection plate of each connection mechanism.

9. The multifunctional bed of claim 8, wherein, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket.

10. The multifunctional bed of claim 6, wherein the plurality of platforms comprises a back platform, a first seat platform, a second seat platform, a thigh platform and a leg platform, each of which having a lower edge and an upper edge, wherein the first seat platform is fixedly attached to a lower portion of the pair of the first side rails of the first support structure and the second seat platform is fixedly attached to an upper portion of the pair of the second side rails of the second support structure such that the lower edge of the first seat platform is adjacent to the upper edge of the second seat platform, and wherein the lower edge of the back platform is pivotally connected to the upper edge of the first seat platform, the upper edge of the thigh platform is pivotally connected to the lower edge of the second seat platform, and the upper edge of the leg platform is pivotally connected to the lower edge of the thigh platform.

11. The multifunctional bed of claim 10, wherein the second support structure further comprises a pair of leg support bars, each leg support bar having one end pivotally connected to one of the pair of second side rails at its lower portion, and another end pivotally connected to the leg platform.

12. The multifunctional bed of claim 10, wherein the lifting mechanism comprises a back lifting actuator pivotally connected between the mounting support bar of the first support structure and the back platform for operably driving the back platform to pivotally move in an upward rotating direction or a downward rotating direction relative to the first support structure.

13. The multifunctional bed of claim 12, wherein the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the mounting support bar of the first support structure and the second end portion of the activation rod is pivotally connected to the back platform, or wherein the motor member is pivotally connected to the back platform and the second end portion of the activation rod pivotally connected to the mounting support bar of the first support structure.

14. The multifunctional bed of claim 10, wherein the lifting mechanism comprises a leg lifting actuator pivotally connected between the second support structure and the leg platform for operably driving the leg platform to pivotally move in an upward rotating direction or a downward rotating direction relative to the second support structure.

15. The multifunctional bed of claim 14, wherein the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the lower rail of the second support structure and the second end portion of the activation rod pivotally connected to the leg platform, or wherein the motor member is pivotally connected to the leg platform and the second end portion of the activation rod pivotally connected to the lower rail of the second support structure.

16. The multifunctional bed of claim 10, wherein the plurality of platforms further comprises a head platform pivotally connected to the upper edge of the back platform, and wherein the lifting mechanism comprises a head platform tilting actuator pivotally and directly connected to the head platform and the back platform for operably adjusting the head platform in a tilting position or a flat position relative to the back platform.

17. A multifunctional bed, comprising:

a support assembly comprising a first support structure and a second support structure foldably connected to the first support structure through a pair of connection mechanisms;

a plurality of platforms disposed on the support assembly;

a lifting mechanism positioned between the frame assembly and the plurality of platforms for operably adjusting positions of at least one of the plurality of platforms so as to adjust the multifunctional bed at a desired position;

a lumbar support mechanism supported by the support assembly for operably providing lumbar support; and one or more massage devices spatial-separately installed on the plurality of platforms, wherein each massage device comprises:

a casing mounted onto a respective platform;

a sonic vibrator; and a vibrator accommodating member received in the casing, comprising an inner plate having an opening defined in the middle for accommodating the sonic vibrator therein and an outer plate spatially surrounding the inner plate and connected to the inner plate by a plurality of elastic connectors.

18. The multifunctional bed of claim 17, wherein each elastic connector is formed in an S shape and has one end connected to the inner plate and the other end connected to the outer plate, such that the inner plate is operably vibrable relative to the outer plate.

19. A multifunctional bed, comprising:

a support assembly comprising a first support structure and a second support structure foldably connected to the first support structure through a pair of connection mechanisms;

a plurality of platforms disposed on the support assembly;

a lifting mechanism positioned between the frame assembly and the plurality of platforms for operably adjusting positions of at least one of the plurality of platforms so as to adjust the multifunctional bed at a desired position; and a lumbar support mechanism supported by the support assembly for operably providing lumbar support, wherein the first support structure comprises a pair of first side rails transversely spaced and longitudinally aligned and each first side rail having an upper end and a lower end; an upper rail having two ends respectfully connected to the upper ends of the pair of first side rails; and a mounting support bar connected to the pair of first side rails and being parallel to the upper rail; and wherein the second support structure comprises a pair of second side rails transversely spaced and longitudinally aligned and each second side rail having an upper end and a lower end; and a lower rail having two ends respectfully connected to the lower ends of the pair of second side rails;

wherein each connection mechanism comprises a connection bracket having a connection plate, and a first side tab and a second side tab vertically extended from two opposite ends of the connection plate so as to define a notched receptacle between the connection plate, the first side tab and the second side tab, wherein each of the first and second side tabs has first and second through holes spatial-apart formed therein, wherein the notched receptacle has a width defined between the first side tab and the second side tab;

wherein each of the lower ends of the pair of first side rails and the upper ends of the pair of second side rails has a groove formed for accommodating the connection plate of each connection mechanism;

wherein, as assembled, the lower ends of the pair of first side rails of the first support structure are respectively received in the notched receptacles of the pair of connection brackets and pivotally and respectively connected to the pair of connection brackets through the first through holes of each connection bracket, and the upper ends of the pair of second side rails of the second support structure are respectively received in the notched receptacles of the pair of connection brackets and pivotally and respectively connected to the pair of connection brackets through the second through holes of each connection bracket; and wherein each connection mechanism further comprises first and second support sleeves, wherein the first support sleeve is disposed between the first side tab of the connection bracket and the inner side of the lower end of one of the pair of first side rails of the first support structure, and the second support sleeve is disposed between the second side tab of the connection bracket and the outer side of the upper end of the corresponding one of the pair of second side rails of the second support structure, so that the pair of second side rails of the second support structure is aligned between the pair of first side rails of the first support structure.

* * * * *